US010908537B2

(12) United States Patent
Yamana

(10) Patent No.: US 10,908,537 B2
(45) Date of Patent: Feb. 2, 2021

(54) IMAGE FORMING APPARATUS

(71) Applicant: CANON KABUSHIKI KAISHA, Tokyo (JP)

(72) Inventor: Kentaro Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/906,014

(22) Filed: Jun. 19, 2020

(65) Prior Publication Data

US 2020/0319577 A1 Oct. 8, 2020

Related U.S. Application Data

(63) Continuation of application No. PCT/JP2018/045749, filed on Dec. 12, 2018.

(30) Foreign Application Priority Data

Dec. 20, 2017 (JP) ..... 2017-243645

(51) Int. Cl.
*G03G 15/16* (2006.01)
*G03G 15/10* (2006.01)

(52) U.S. Cl.
CPC ..... *G03G 15/161* (2013.01); *G03G 15/10* (2013.01); *G03G 15/162* (2013.01); *G03G 2215/1661* (2013.01)

(58) Field of Classification Search
CPC ..... G03G 15/10
See application file for complete search history.

(56) References Cited

U.S. PATENT DOCUMENTS

| | | | | |
|---|---|---|---|---|
| 6,151,469 | A | 11/2000 | Lee | |
| 7,590,368 | B2 | 9/2009 | Kamijo et al. | |
| 2009/0232536 | A1 | 9/2009 | Nishimura et al. | |
| 2011/0182611 | A1 | 7/2011 | Hofmann et al. | |
| 2011/0262170 | A1* | 10/2011 | Kozuma | G03G 15/161 399/71 |

FOREIGN PATENT DOCUMENTS

| | | | |
|---|---|---|---|
| JP | 2001-109346 | A | 4/2001 |
| JP | 2002-318493 | A | 10/2002 |
| JP | 2007-147973 | A | 6/2007 |
| JP | 2009-244840 | A | 10/2009 |
| JP | 2011-158905 | A | 8/2011 |

OTHER PUBLICATIONS

International Search Report dated Feb. 12, 2019, in International Patent Application No. PCT/JP2018/045479.

* cited by examiner

*Primary Examiner* — Victor Verbitsky
(74) *Attorney, Agent, or Firm* — Venable LLP

(57) ABSTRACT

In an image forming apparatus, at least a part of a cleaning roller is provided on the same side as an opposed roller with respect to an external common tangent Z of a first roller and a second roller. In a case in which a surface velocity of the driving roller is designated as v1; a surface velocity of the cleaning roller is designated as v2; a radius of the cleaning roller is designated as r; a radius of the opposed roller is designated as s; and a distance between the center of rotation of the cleaning roller and the center of rotation of the opposed roller is designated as x, the cleaning roller is rotated so as to satisfy a relationship: $v2/v1<r/(x-s)$.

12 Claims, 13 Drawing Sheets

IMAGE FORMING APPARATUS

CROSS-REFERENCE TO RELATED APPLICATIONS

This application is a Continuation of International Patent Application No. PCT/JP2018/045749, filed Dec. 12, 2018, which claims the benefit of Japanese Patent Application No. 2017-243645, filed Dec. 20, 2017, both of which are hereby incorporated by reference herein in their entirety.

BACKGROUND OF THE INVENTION

Field of the Invention

The present invention relates to an image forming apparatus of an electrophotographic system, by which an image is formed using a liquid developer.

Description of the Related Art

Image forming apparatuses configured to develop an electrostatic latent image formed on a photosensitive drum into a toner image using a liquid developer including a toner and a carrier liquid; to subject the developed toner image to primary transfer onto a transfer drum; and to subject the toner image that has been primary transferred onto the transfer drum, to secondary transfer onto a recording material, have been hitherto suggested. In the apparatus that uses a liquid developer as described in JP-A-2011-158905, a cleaning roller is in close contact with a transfer drum in order to remove the toner remaining on the transfer drum after secondary transfer. The toner moves by means of a liquid developer from the transfer drum to the cleaning roller along with an electric field formed concomitantly to the application of voltage to the cleaning roller in a nip portion formed by the cleaning roller and the transfer drum closely contacting with each other (so-called electrophoresis). Then, the toner that has moved to the cleaning roller is removed by a cleaning blade that rubs the cleaning roller.

Furthermore, in JP-A-2002-318493, an image forming apparatus that uses a dry developer instead of a liquid developer, the image forming apparatus having a pair of rollers arranged therein in order to remove any toner remaining on an intermediate transfer belt, such as an opposed roller on the inner side of the belt and a cleaning roller on the outer side of the belt, has been suggested. In this apparatus, the opposed roller and the cleaning roller are arranged so as to project the intermediate transfer belt interposed between the opposed roller and the cleaning roller, on the inner side of the belt.

Meanwhile, in the case of an apparatus equipped with an intermediate transfer belt as an image forming apparatus that uses a liquid developer, a nip portion should be secured in order to clean the toner by causing the toner to move from the intermediate transfer belt to the cleaning roller by electrophoresis by means of a liquid developer. Thus, also in the case of an image forming apparatus that uses a liquid developer, it may be considered to project the intermediate transfer belt on the inner side of the belt by means of the cleaning roller. However, in such a case, the front and rear surface velocities of the intermediate transfer belt differ from each other at the nip portion due to the difference in the curvature of the belt. Therefore, in a case in which the cleaning roller is driven at the same velocity as that of a driving roller that drives the intermediate transfer belt, the belt portion between the cleaning roller and the driving roller becomes loose, and there is a risk that running of the belt may become unstable, or the belt may be disengaged. Particularly, in the case of an intermediate transfer belt having an elastic layer in which the outer peripheral side (front side) is more elastic than the inner peripheral side (rear side), with the elastic layer having some thickness, a difference in the moving direction length is therefore very highly likely to occur between the outer periphery and the inner periphery of the belt, due to the expansion and contraction concomitant to elastic deformation of the elastic layer.

SUMMARY OF THE INVENTION

According to one aspect of the present invention, an image forming apparatus includes a belt member configured to rotate while carrying a liquid developer including a toner and a carrier liquid, the belt member being nipped respectively at a first transfer position for transferring a toner image onto the belt member and at a second transfer position for transferring the transferred toner image onto a recording material, a cleaning roller disposed upstream of the first transfer position and downstream of the second transfer position with respect to a moving direction of the belt member, the cleaning roller being configured to contact with an outer peripheral surface of the belt member at a contact portion and clean the belt member, the cleaning roller being driven in the same direction as the moving direction of the belt member at the contact portion, an opposed roller configured to oppose the cleaning roller, with the belt member being interposed therebetween, a driving roller disposed upstream of the first transfer position and downstream of the contact portion with respect to the moving direction of the belt member, the driving roller contacting with an inner peripheral surface of the belt member and driving the belt member, a first driving source configured to drive the cleaning roller, and a second driving source configured to drive the driving roller. When a roller disposed downstream of the contact portion and upstream of the first transfer position and adjacent to the cleaning roller or the opposed roller on a downstream side in the moving direction of the belt member and configured to tension the belt member is designated as a first roller, and a roller disposed upstream of the contact portion and downstream of the first transfer position and adjacent to the cleaning roller or the opposed roller on an upstream side in the moving direction of the belt member and configured to tension the belt member is designated as a second roller, at least a part of the cleaning roller is provided on the same side as the opposed roller with respect to an external common tangent of the first roller and the second roller. In a case in which a surface velocity when the driving roller is driven is designated as v1; a surface velocity when the cleaning roller is driven is designated as v2; a radius of the cleaning roller is designated as r; a radius of the opposed roller is designated as s; and a distance between the center of rotation of the cleaning roller and the center of rotation of the opposed roller is designated as x, the cleaning roller is rotated so as to satisfy a relationship: $v2/v1<r/(x-s)$.

Further features of the present invention will become apparent from the following description of exemplary embodiments with reference to the attached drawings.

DESCRIPTION OF THE EMBODIMENTS

First Embodiment

Image Forming Apparatus

Figure 1:
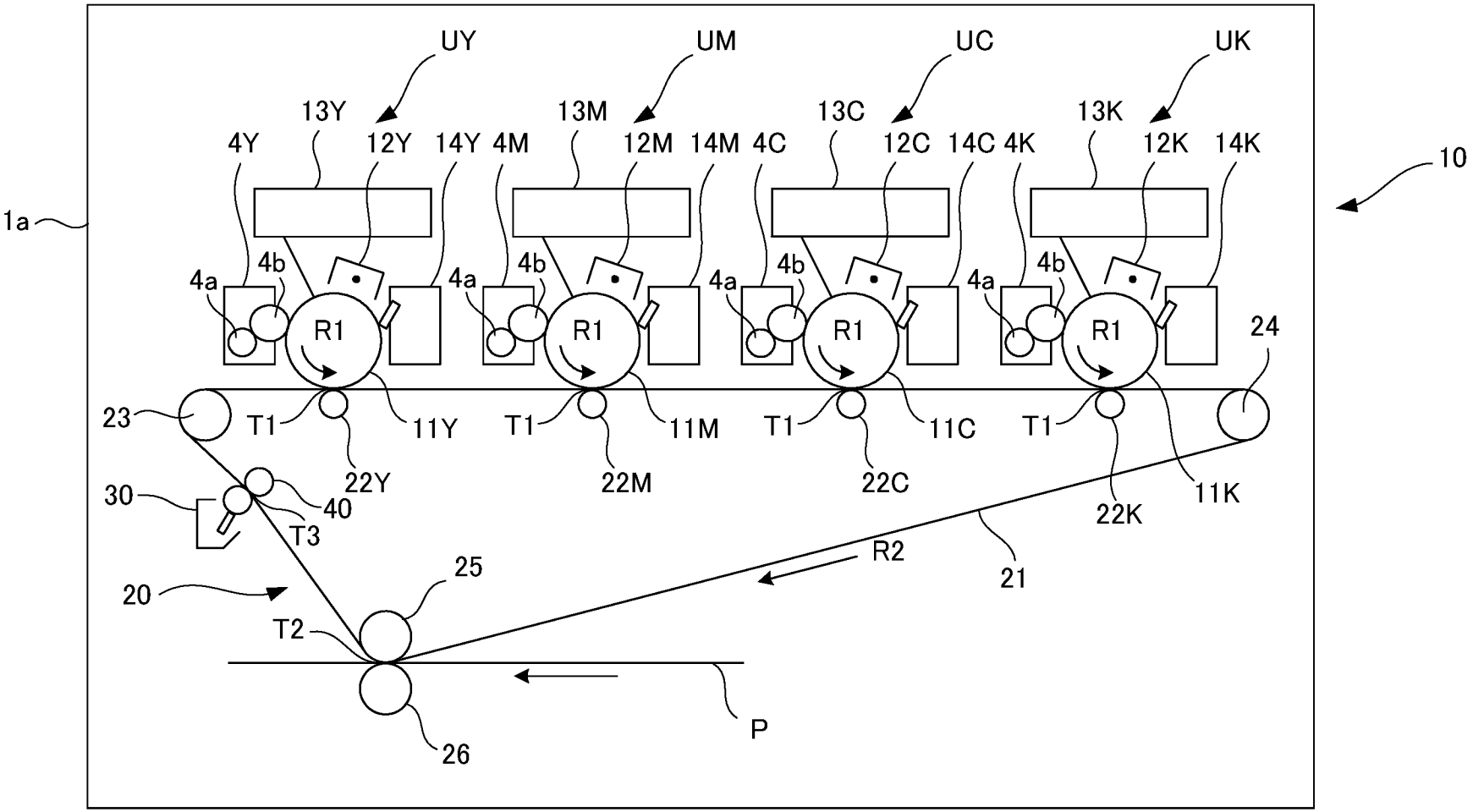
FIG. 1 is a schematic diagram illustrating the configuration of an image forming apparatus of the present embodiment.

A first embodiment will be described. First, the configuration of an image forming apparatus of the present embodiment will be described using FIG. 1. The image forming apparatus 10 shown in FIG. 1 is a full color printer of an intermediate transfer system having a tandem configuration in which a plurality of image forming units UY, UM, UC, and UK are arranged. In the case of the present embodiment, an intermediate transfer unit 20 is disposed in the lower part in the direction of gravitational force of a plurality of image forming units UY to UK.

The intermediate transfer unit 20 includes an endless intermediate transfer belt 21 serving as a belt member, primary transfer rollers 22Y to 22K, a driving roller 23, a tension roller 24, and a secondary transfer inner roller 25. The intermediate transfer belt 21 is supported so as to bridge over rollers such as the driving roller 23, the tension roller 24, and the secondary transfer inner roller 25, and is driven by the driving roller 23 to rotate in the direction of arrow R2 shown in FIG. 1. According to the present embodiment, the secondary transfer inner roller 25 serving as a second roller is fixed to be freely rotatable on the inner peripheral side of the intermediate transfer belt 21 and applies tension to the intermediate transfer belt 21. On the other hand, the driving roller 23 serving as a first roller is fixed to be freely rotatable on the inner peripheral side of the intermediate transfer belt 21 and applies tension to the intermediate transfer belt 21 at a position downstream of the secondary transfer inner roller 25 in the moving direction of the intermediate transfer belt 21. Regarding the driving roller 23, in order to increase the friction coefficient $\mu 1$ between the driving roller 23 and the intermediate transfer belt 21 (for example, $\mu 1>0.4$), a roller having a metal core bar wound with rubber, a roller having its core bar surface spray coated with a resin material, or the like is used.

The image forming units UY to UK are arranged along the moving direction (direction of arrow R2 shown in FIG. 1) of the intermediate transfer belt 21. At the image forming unit UY, a yellow toner image is formed on a photosensitive drum 11Y and is transferred onto the intermediate transfer belt 21. At the image forming unit UM, a magenta toner image is formed on a photosensitive drum 11M and is transferred onto the intermediate transfer belt 21. At the image forming units UC and UK, a cyan toner image and a black toner image are formed on photosensitive drums 11C and 11K, respectively, and are transferred onto the intermediate transfer belt 21. The four-colored toner image that has been transferred onto the intermediate transfer belt 21 is conveyed to a secondary transfer unit T2 and is collectively transferred onto a recording material P (paper, a sheet material such as an OHP sheet, or the like). In the present embodiment, the intermediate transfer belt 21 rotates while carrying a liquid developer including a toner and a carrier liquid.

The image forming units UY to UK are configured to be almost the same, except that the colors of the toners used at the developing units 4Y, 4M, 4C, and 4K serving as supply-receiving units vary into yellow, magenta, cyan, and black. Thus, in the following description, the configuration and operation of the image forming units UY to UK will be described by omitting the characters Y, M, C, and K at the end of the reference symbols representing the distinction of the image forming units UY, UM, UC, and UK.

At the image forming unit U, a primary charger 12, an exposing unit 13, a developing unit 4, and a drum cleaning unit 14 are disposed so as to surround the photosensitive drum 11 serving as a photosensitive member. At the image forming unit U, a primary transfer unit T1 (transfer nip) is formed as a first transfer position at which a toner image is primarily transferred between the photosensitive drum 11 and the intermediate transfer belt 21 by the primary transfer roller 22. That is, the photosensitive drum 11 is disposed at a position facing the primary transfer roller 22, with the intermediate transfer belt 21 interposed therebetween. The photosensitive drum 11 has a photoconductive layer formed on the outer peripheral surface of an aluminum cylinder and is rotated in the direction of arrow R1 shown in FIG. 1 at a predetermined process speed.

The primary charger 12 irradiates the photosensitive drum 11 with, for example, electrically charged particles associated with corona discharge, and the primary charger 12 charges the photosensitive drum 11 to a uniform negative dark potential. The exposing unit 13 uses a rotating mirror to scan a laser beam generated by on-off modulating scanning line image data obtained by expanding a decomposed color image of each color, and thereby writes in an electrostatic latent image of the image on the surface of a charged photosensitive drum 11. This electrostatic latent image is developed as a toner image by the developing unit 4.

The developing unit 4 accommodates a liquid developer obtained by dispersing a powdery toner as a dispersoid in a carrier liquid as a dispersing medium. To the developing unit 4, a liquid developer is supplied from a mixer that is not shown in the diagram. The liquid developer supplied from the mixer to the developing unit 4 is employed to coat (supply) a developing roller 4*b* by a coating roller 4*a* in the developing unit 4 and is used for development. The developing roller 4*b* carries the liquid developer on the surface and conveys the liquid developer, and the electrostatic latent image formed on the photosensitive drum 11 is developed with the toner. Such coating of the liquid developer from the coating roller 4*a* to the developing roller 4*b*, and the development of the electrostatic latent image on the photosensitive drum 11 from the developing roller 4*b* are respectively carried out using an electric field. Meanwhile, the liquid developer that has not been supplied to the development is returned to the mixer from the developing unit 4 and reused.

At the primary transfer unit T1 formed by the primary transfer roller 22, the toner image formed on the photosensitive drum 11 is subjected to primary transfer onto the intermediate transfer belt 21 using the electric field. After the primary transfer, the liquid developer (toner and carrier liquid) remaining on the photosensitive drum 11 is collected by a drum cleaning apparatus 14.

The secondary transfer unit T2 serving as a second transfer position is a toner image transfer nip toward a recording material P, which is formed by a secondary transfer outer roller 26 closely contacting with the intermediate transfer belt 21 supported by a secondary transfer inner roller 25. At the secondary transfer unit T2, a secondary transfer voltage is applied to the secondary transfer outer roller 26 serving as a transfer member, and thereby the toner image is subjected to secondary transfer from the intermediate transfer belt 21 to the recording material P that is conveyed to the secondary transfer unit T2. The toner remaining on the intermediate transfer belt 21 after the secondary transfer (residual toner) is removed together with the carrier liquid by a belt cleaning apparatus 30. The belt cleaning apparatus 30 will be described below (see FIG. 2A).

The recording material P having the four-colored toner image secondarily transferred thereon at the secondary transfer unit T2 is conveyed to a fixing unit or the like, which is not shown in the diagram, and the toner image transferred onto the recording material P is fixed by the fixing unit or the like. The recording material P having the toner image fixed thereon is discharged out of the apparatus body (out of the machine).

Liquid Developer

Next, the liquid developer used in the developing units 4Y to 4K will be described. Regarding the liquid developer, any liquid developer that has been hitherto used may be used; however, in the present embodiment, an ultraviolet-curable liquid developer is used.

The liquid developer is an ultraviolet-curable liquid developer including a cationically polymerizable liquid monomer, a photopolymerization initiator, and toner particles that are insoluble in the cationically polymerizable liquid monomer. Furthermore, the cationically polymerizable liquid monomer is a vinyl ether compound, and the photopolymerization initiator is a compound represented by the following General Formula (Chem 1).

General Formula (1)

Chem 1

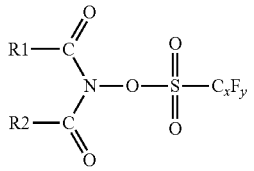

The present invention will be described more specifically. First, the toner particles have a coloring material that gives a color, enclosed with a toner resin. Furthermore, the toner particles may also contain other materials such as a charge control agent, together with the toner resin and the coloring material. Regarding a method for producing toner particles, known technologies such as coacervation of dispersing a coloring material and gradually polymerizing a resin to enclose the coloring material; and an internal pulverization method of melting a resin or the like and enclosing a coloring material inside the resin, may be used. For the toner resin, an epoxy resin, a styrene-acrylic resin, or the like is used. The coloring material that gives a color may be a general organic or inorganic pigment. Furthermore, in view of production, a dispersant is used in order to increase toner dispersibility; however, a synergist can also be used.

A curable liquid serving as a carrier liquid is composed of a charge control agent that charges the toner surface, a photopolymerization agent generating acid when irradiated with ultraviolet radiation (UV), and a monomer that is bonded by acid. The monomer is a vinyl ether compound that is polymerized by a cationic polymerization reaction. Furthermore, apart from the photopolymerization agent, the curable liquid may also contain a sensitizer. Since preservability is decreased by photopolymerization, a cation polymerization inhibitor may be incorporated in an amount of 10 to 5,000 ppm. In addition, a charge control aid, other additive materials, and the like may also be used.

The ultraviolet curing agent (monomer) of this developer is a mixture of about 10% (% by weight) of a monofunctional monomer having one vinyl ether group represented by Chemical Formula (Chem 2) and about 90% of a bifunctional monomer having two vinyl ether groups represented by Chemical Formula (Chem 3).

Chem 2

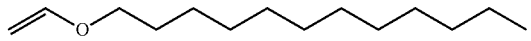

Chem 3

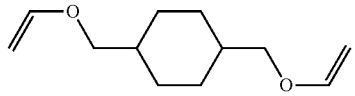

The photopolymerization initiator has 0.1% of a compound represented by the following (Chem 4) mixed therein. When this photopolymerization initiator is used, satisfactory fixing is enabled, and a highly resistant liquid developer is obtained, unlike the case of using an ionic photo-acid generator.

Chem 4

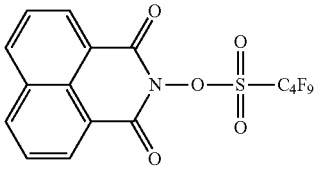

It is desirable that the cationically polymerizable liquid monomer is a compound selected from the group consisting of dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether.

Furthermore, regarding the charge control agent, known agents can be used. Specific examples of the compound include oils and fats such as linseed oil and soybean oil; alkyd resins, halogen polymers, aromatic polycarboxylic acids, acidic group-containing water-soluble dyes, oxidative condensates of aromatic polyamines, metal soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexanoate; sulfonic acid metal salts such as petroleum-based sulfonic acid metal salts, and metal salts of sulfosuccinic acid esters; phospholipids such as lecithin; salicylic acid metal salts such as t-butyl salicylic acid metal complexes; polyvinylpyrrolidone resins, polyamide resins, sulfonic acid-containing resins, and hydroxybenzoic acid derivatives.

Belt Cleaning Apparatus

Figure 2A:
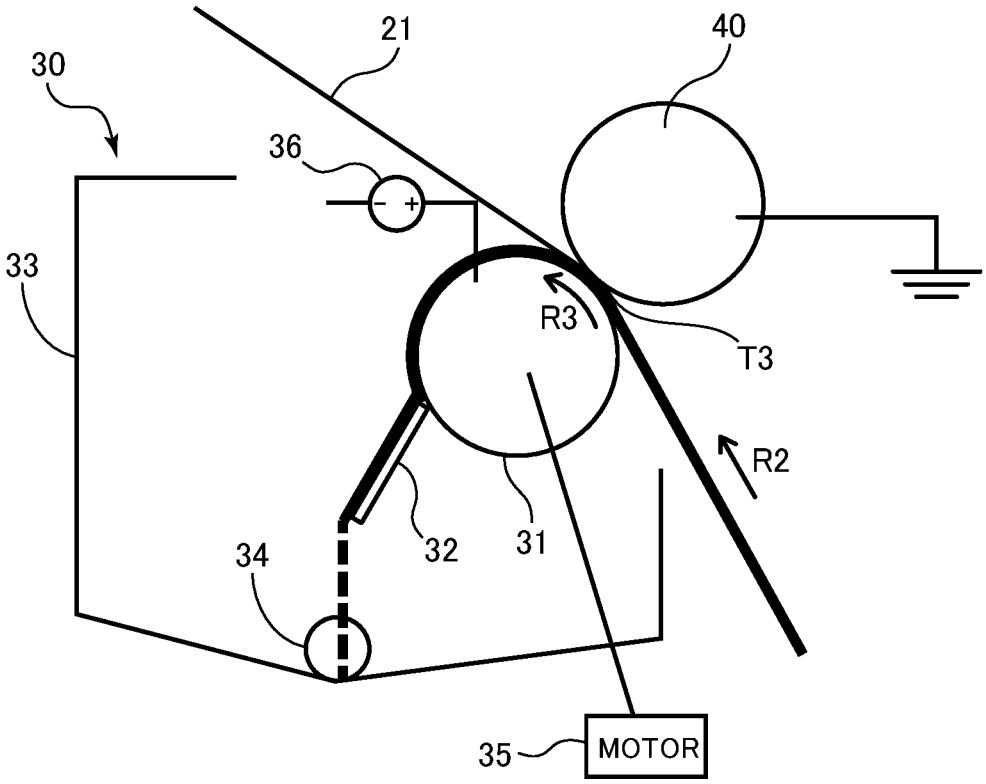
FIG. 2A is a schematic diagram illustrating the configuration of a belt cleaning apparatus of a first embodiment.
Figure 2B:
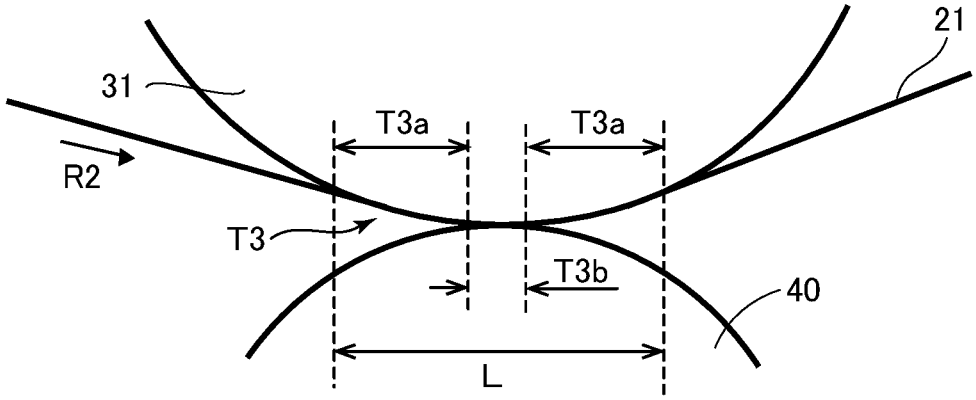
FIG. 2B is a magnified diagram illustrating a nip portion in the belt cleaning apparatus of the first embodiment.

The configuration of a belt cleaning apparatus 30 of the present embodiment will be described using FIG. 2A and FIG. 2B. As shown in FIG. 2A, the belt cleaning apparatus 30 includes a cleaning container 33 that forms a casing, a cleaning roller 31, a cleaning blade 32, an opposed roller (a counter roller) 40, and the like.

The opposed roller 40 is provided to be freely rotatable on the inner peripheral side of the intermediate transfer belt 21, and is in close contact with the inner peripheral surface (rear surface) of the intermediate transfer belt 21 between a secondary transfer inner roller 25 and a driving roller 23 (see FIG. 1) in relation to the moving direction (direction of arrow R2) of the intermediate transfer belt 21. The opposed roller 40 rotates while being driven by the intermediate transfer belt 21. The cleaning container 33 is such that a portion facing the intermediate transfer belt 21 is opened, and the cleaning roller 31 is provided in a rotatable manner so as to be exposed to the outside at this portion. The cleaning roller 31 is disposed opposite to the opposed roller 40, with the intermediate transfer belt 21 being interposed therebetween, and is in close contact with the outer peripheral surface (front surface) of the intermediate transfer belt 21. The opposed roller 40 and the cleaning roller 31 are in close contact with the inner peripheral surface and the outer peripheral surface, respectively, of the intermediate transfer belt 21 and thereby form a cleaning nip portion T3 (hereinafter, simply described as nip portion T3) serving as a contact portion. According to the present embodiment, the nip portion T3 is formed by causing the intermediate transfer belt 21 to be wound around the cleaning roller 31, so as to have a physical nip T3*b* and a tension nip T3*a* shown in FIG. 2B. According to the present specification, the physical nip T3*b* serving as a first contact portion refers to a region in which the opposed roller 40 and the cleaning roller 31 are simultaneously in close contact with the intermediate transfer belt 21 at the front and rear, and the tension nip T3*a* refers to a region in which only the cleaning roller 31 is in close contact (close contact region). The cleaning roller 31 is in close contact with the intermediate transfer belt 21 at the front surface of the close contact region, and the opposed roller 40 is in close contact with the intermediate transfer belt 21 at the rear surface of the close contact region. The tension nip T3*a* serving as a second contact portion refers to a region in which the opposed roller 40 is not in contact, and only the cleaning roller 31 is in close contact. Furthermore, the cleaning roller 31 is in close contact with the intermediate transfer belt 21 carrying a liquid developer, in a state in which the friction coefficient $\mu 2$ between the cleaning roller 31 and the intermediate transfer belt 21 is less than the friction coefficient $\mu 1$ between the driving roller 23 and the intermediate transfer belt 21 ($\mu 1 > \mu 2$, for example, $\rho 2 < 0.15$).

The present embodiment is configured such that the physical nip T3*b* is secured by the opposed roller 40 and the cleaning roller 31. The reason for this is that discharge that is prone to occur in the vicinity of the nip portion T3 should be suppressed as much as possible. That is, when discharge occurs in the vicinity of the nip portion T3, a stronger electric field is needed in order to perform electrostatic cleaning of the toner on the intermediate transfer belt 21, and accordingly, there are concerns about the damage to the intermediate transfer belt 21 being increased. In the present embodiment, as will be described below, an elastic belt having an elastic layer is used as the intermediate transfer belt 21. Such an intermediate transfer belt 21 has high electrical resistance, and therefore, discharge is prone to occur particularly in the vicinity of the nip portion T3.

The cleaning roller 31 is driven to rotate in the same direction (direction of arrow R3) as the moving direction of the intermediate transfer belt 21 at the nip portion T3 with the intermediate transfer belt 21, by a motor 35 serving as a first driving source. As will be described below in detail, in the case of the present embodiment, the cleaning roller 31 is rotated such that the surface velocity of the roller is slower than the surface velocity of the intermediate transfer belt 21 at the nip portion T3. Then, the cleaning roller 31 electrically removes the toner remaining on the intermediate transfer belt 21 without being secondarily transferred by means of the action of an electric field (so-called electrophoresis). In the case of the present embodiment, the opposed roller 40 is earthed, while the cleaning roller 31 is connected to a power supply 36, and a voltage of opposite polarity to the polarity of the toner is applied to the cleaning roller 31 by the power supply 36. Then, the toner remaining on the intermediate transfer belt 21 (on intermediate transfer belt) is moved from the intermediate transfer belt 21 to the cleaning roller 31 by means of a liquid layer of the liquid developer formed between the intermediate transfer belt 21 and the cleaning roller 31 at the nip portion T3. Meanwhile, since the cleanability achieved by electrophoresis increases proportionally to the passage time of the nip portion T3, it is desirable that the surface velocity of the intermediate transfer belt 21 and the surface velocity of the cleaning roller 31 at the nip portion T3 are the same. However, in order to satisfy the cleaning performance by electrophoresis at the nip portion T3, it has been verified by experiments of the inventors that the relative velocity between the surface velocity of the intermediate transfer belt 21 and the surface velocity of the cleaning roller 31 is desirably within ±10%.

The toner that has moved to the cleaning roller 31 is removed by a cleaning blade 32 together with the liquid developer. The cleaning blade 32 is, for example, a plate-shaped member made of a metal such as stainless steel, and is in close contact with the cleaning roller 31 on the downstream side in the moving direction from the nip portion T3 in relation to the moving direction of the cleaning roller 31. The toner removed by the cleaning blade 32 flows inside the cleaning container 33 along the direction of gravity together with the liquid developer and falls. The bottom face of the cleaning container 33 is formed in an inclined shape, and a sheet discharge port 34 is formed at the lowest part of the inclined bottom face. Therefore, the liquid developer including the toner removed by the cleaning blade 32 is delivered to the sheet discharge port 34 along the bottom face of the cleaning container 33 and is discharged out of the cleaning container 33 through the sheet discharge port 34.

Cleaning Roller

The above-described cleaning roller 31 will be explained. In an image forming apparatus that uses a liquid developer, it is desirable to use a cleaning roller 31 formed from a material that does not easily react with the organic solvent or the like included in the liquid developer. This is because the durability of the roller is increased by making it difficult to induce deterioration caused by dissolution or denaturing attributed to the compounds used for the carrier liquid. Generally, when the difference between the respective solubility parameter (SP) values of the roller and the organic solvent is 2 or more, the roller is more likely to deteriorate than in the case in which the difference of the SP value is less than 2 (that is, deterioration of the roller is accelerated). In the present embodiment, from the viewpoint of slowing down the deterioration of the roller, for example, a metal roller made of stainless steel or aluminum is used as the cleaning roller 31. As the metal roller, a metal roller having its surface thinly coated with a fluororesin or the like to the extent that the shape conformity depending on deformation will not change, may be used. Meanwhile, since there is less chance for the opposed roller 40 to be exposed to the liquid developer compared to the cleaning roller 31, it is not necessarily essential to use a metal roller, and a rubber roller may be used. However, when deterioration of the roller is taken into consideration, it is preferable to use a metal roller also for the opposed roller 40.

In the case of an image forming apparatus that uses a dry developer, it is difficult to use a metal roller as the cleaning roller 31. That is, when the toner included in a dry developer is an insulator, and the cleaning roller 31 is a metal roller having low electrical resistance, the toner having reversed polarity may fuse together due to the discharge occurring at the nip portion or the gap in the vicinity thereof. Then, the cleaning performance is deteriorated. In contrast, in the case of an image forming apparatus that uses a liquid developer, even if discharge occurs, the polarity of the toner is substantially not reversed. Further, since the toner moves through the liquid layer of the liquid developer by means of electrophoresis, it is possible to use a metal roller. However, when a metal roller is compared with a rubber roller, the shape conformity caused by deformation is very low. Thus, in a case in which a metal roller is used as the cleaning roller 31, it is necessary to secure the nip length of the nip portion T3 (the moving direction length of the intermediate transfer belt 21) so that the toner can be reliably moved by electrophoresis. As will be described below in detail (see FIG. 5), in the present embodiment, the nip length of the nip portion T3 is secured by projecting the cleaning roller 31 against the intermediate transfer belt 21 on the inner side of the belt such that the intermediate transfer belt 21 is wound around the cleaning roller 31.

Intermediate Transfer Belt

The intermediate transfer belt 21 will be explained. The intermediate transfer belt 21 is an elastic belt having a base layer 21*a* and an elastic layer 21*b* (see FIG. 5 that will be described below). The base layer 21*a* is a semi-electroconductive belt-shaped member formed from a resin containing a conductive agent. The resin used for the base layer 21*a* may be any thermosetting resin or any thermoplastic resin; however, from the viewpoint of strength and durability, representative examples include resins such as polyimide, polyamideimide, polyether ether ketone, polyphenylene sulfide, and polyester. Regarding these resins, either a single resin or a resin mixture may be used, and an optimal resin is selectively used according to the characteristics such as the mechanical strength required from the belt.

Around the base layer 21*a*, an elastic layer 21*b* that is more elastic than the base layer 21*a* is formed. The elastic layer 21*b* is formed from a rubber having a Young's modulus (E2) lower than the Young's modulus (E1) of the base layer, or the like (E1>E2). Furthermore, the elastic layer 21*b* is such that its thickness (t2) is larger than the thickness (t1) of the base layer 21*a* (t1<t2). In a case in which the thickness of such an intermediate transfer belt 21 is 1 mm or less, if a metal roller having a diameter larger than 40 mm is not used as the cleaning roller 31, it is difficult to secure a sufficient nip length that is enough for removing most of the toner. There is a need to secure a nip length of, for example, 1.2 mm or more. However, from the viewpoint that when a metal roller has an increased diameter, the weight becomes heavier by the square, it is preferable to use a metal roller having a diameter of 40 mm or less as the cleaning roller 31.

Figure 3:
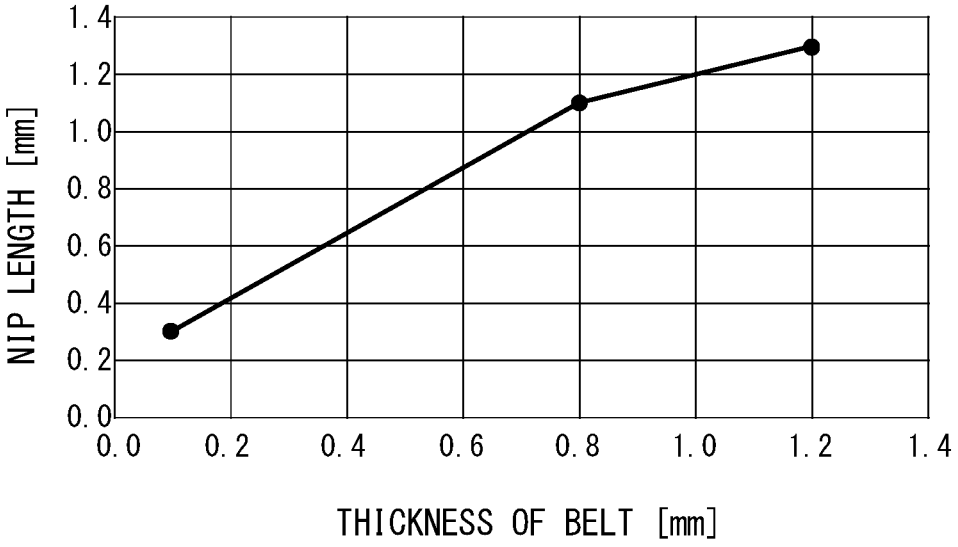
FIG. 3 is a graph showing the relationship between the thickness of the belt and the nip length.

Here, with regard to the nip length of the nip portion formed in a case in which the metal roller is pressed against an endless belt, an experiment of investigating the nip length by varying the thickness of the belt was carried out. The experiment results are presented in FIG. 3. In FIG. 3, the axis of abscissa represents the thickness of the belt, and the axis of ordinate represents the nip length. Elastic belts each having a base layer 21*a* formed from polyimide and having a thickness of 0.1 mm, and an elastic layer 21*b* formed from urethane sponge and having a thickness of 0.8 mm or 1.2 mm on the base layer 21*a* were used as the belt, and the respective nip lengths were measured. Meanwhile, the contact pressure between the belt and the metal roller was set to 80 N, and the length in the moving direction (longitudinal direction) of the belt was set to 400 mm. Furthermore, Young's modulus of the elastic layer 21*b* was adjusted to 0.3 (MPa). The Young's modulus can be measured using "FISCHERSCOPE HM2000S" (manufactured by Fischer Technology, Inc.).

As shown in FIG. 3, when the thickness of the belt is not 1 mm or more, a nip length sufficient for removing the toner (for example, 1.2 mm) cannot be secured at a contact pressure of 80 N. Thus, it may be considered to adjust the contact pressure to 80 N or higher in order to secure a nip length sufficient for removing the toner. However, when the contact pressure is set to be too high, the belt is prone to undergo fracture. In the present embodiment, the upper limit of the contact pressure is set to 300 N. In particular, when an elastic belt is used as the intermediate transfer belt carrying a liquid developer, microcracks are likely to be generated concomitantly with the expansion and contraction of the belt attributed to pressing of a metal roller, the liquid developer infiltrates into the microcracks, and thereby the belt may swell, or the electrical resistivity of the belt may change. In order to avoid this, it is desirable to use a belt having a thin elastic layer having a thickness of 1 mm or less as the intermediate transfer belt 21. However, in order to secure a nip length sufficient for removing the toner, in the present embodiment, the thickness (t2) of the elastic layer 21*b* was made larger than the thickness (t1) of the base layer 21*a* (t1<t2) as described above, and then the thickness of the intermediate transfer belt 21 was adjusted to, for example, 1.0 mm or more.

Meanwhile, in a case in which the contact pressure is too low, it may be considered that the distance between the opposed roller 40 or the cleaning roller 31 and the belt is increased by thickness unevenness of the belt or driving unevenness at the time of rotation. In this case, the physical nip width or the tension nip width disappears, and the cleaning ability is deteriorated. Therefore, it is desirable that the contact pressure is as low as possible (for example, 30 N), to the extent that variation does not occur in the nip width described above. In the present embodiment, the lower limit of the contact pressure is set to 30 N. As such, in the present embodiment, the contact pressure was adjusted to be from 30 N to 300 N.

Electrophoresis of Toner

Figure 4:
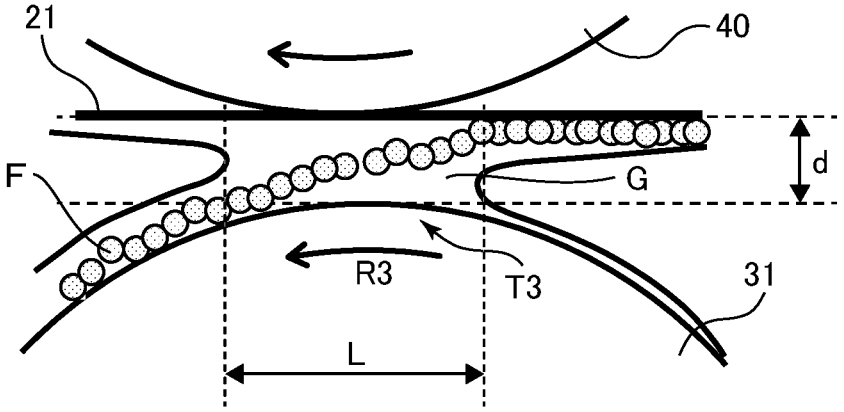
FIG. 4 is a diagram explaining the electrophoresis of toner.

Next, electrophoresis of the toner at the nip portion T3 will be described using FIG. 4. FIG. 4 is a diagram intended for modeling and explaining the electrophoresis of the toner, and herein, the intermediate transfer belt 21 is shown to be in a straight-line form, on account of the convenience in depiction.

As described above, the belt cleaning apparatus 30 electrically removes the toner F on the intermediate transfer belt 21 by means of the action of an electric field (so-called electrophoresis). At that time, it is necessary to secure the nip length L at the nip portion T3 so that the toner F can be reliably moved from the intermediate transfer belt 21 to the cleaning roller 31 by electrophoresis, and the nip length L (m) is a length that satisfies the following Formula 1.

$$(\mu \times E) \times (L/P) > d \qquad \text{Formula 1}$$

In Formula 1, μ ($m^2/(V \times s)$) represents the toner mobility; E (V/m) represents the strength of the electric field generated at the nip portion T3 concomitantly with application of a voltage to the cleaning roller 31; P (m/s) represents the rotational speed of the intermediate transfer belt 21; and d (μm) represents the liquid thickness of the liquid developer G at the nip portion T3. Meanwhile, the nip length L is the length over which, in a case in which a so-called solid image obtained by loading the toner over the entire surface of the recording material is subjected to secondary transfer as a toner image, the toner remaining on the intermediate transfer belt 21 after secondary transfer is cleaned by electrophoresis.

Then, the left-hand side of Formula 1 is the product of the moving velocity of the toner as represented by (μ×E) and the passage time pertaining to the passage of the nip portion T3 as represented by (L/P), that is, the distance over which the toner can move by electrophoresis from the intermediate transfer belt 21 toward the cleaning roller 31. On the other hand, the right-hand side of Formula 1 is, as described above, the liquid thickness of the liquid developer at the nip portion T3. That is, when a nip length L where the left-hand side of Formula 1 is larger than the right-hand side is secured, the toner can move from the intermediate transfer belt 21 to the cleaning roller 31 by means of the liquid thickness of the liquid developer while passing through the nip portion T3. For instance, the toner mobility is $1.00^{-10}$ to $1.00^{-11}$ ($m^2/(V \times s)$). The electric field is 90 (V/μm). The rotational speed of the intermediate transfer belt 21 is 600 (mm/s). The liquid thickness d of the liquid developer at the nip portion T3 is 2 (μm). In such a case, the nip length L may be secured to be 1.5 (mm) or more. However, when the nip length L is made long, the winding angle of the intermediate transfer belt 21 with respect to the cleaning roller 31 becomes large. In that case, since the intermediate transfer belt 21 is likely to bend repeatedly along with this rotation, it is not preferable from the viewpoint of the belt lifetime. In view of this point, the winding angle of the intermediate transfer belt 21 with respect to the cleaning roller 31 is preferably less than 90°. The winding angle is more preferably less than 45°, and even more preferably less than 20°.

Here, the measurement of the toner mobility in Formula 1 described above, the electric field, the nip length, and the liquid thickness of the liquid developer will be described. The toner mobility μ can be represented by the following Formula 2.

$$\mu = |v/E| = Q/(6\pi \times \eta \times \alpha) \qquad \text{Formula 2}$$

In Formula 2, v (m/s) represents the moving velocity of the toner; and E (V/m) represents the strength of the electric field generated at the nip portion T3 concomitantly with application of a voltage to the cleaning roller 31. Furthermore, Q (C) represents the amount of charge carried by the toner in the liquid developer; π represents the ratio of the circumference of a circle to its diameter; n represents the viscosity (Pa·s) of the liquid developer; and α (μm) represents the diameter of the toner. For instance, the viscosity of the liquid developer is 4.0 (Pa·s), the outer diameter of the toner is 1.0 (μm), and the toner mobility can be calculated from these parameters. Furthermore, the moving velocity of the toner in the case of the present embodiment is about 9 to 90 (m/s). The amount of charge of the toner can be calculated from the above-described various parameters that have been quantitatively determined. Meanwhile, the toner mobility can be quantitatively determined by making measurement using a measuring device such as a zeta potentiometer measuring apparatus, Zeta-APS (manufactured by Matec Applied Sciences, Inc.).

The electric field can be generally determined by the following Formula 3. β (V) represents the voltage value applied to the cleaning roller 31; and d (μm) represents the liquid thickness of the liquid developer at the nip portion T3.

$$E = \beta/d \qquad \text{Formula 3}$$

With regard to the electric field, the route including from the cleaning roller 31 to the opposed roller 40 via the liquid developer and the resistor of the intermediate transfer belt 21 is subjected to modeling using a series circuit, and the electric field can be determined by the circuit calculation. For instance, the voltage value applied to the cleaning roller 31 is 1,000 (V), the electrical resistivity of the liquid developer is 6.0E+6 (Ω·cm), and the liquid thickness of the liquid developer is 2 (μm). Furthermore, the electrical resistivity of the intermediate transfer belt 21 is 1.0E+10 (Ω·cm), and the thickness of the intermediate transfer belt 21 is 100 (μm). In this case, the electric field is calculated to be about 90 (V/μm).

Regarding the nip length, a momentary stop is induced by cutting the main power supply in the middle of image formation or the like, and the length of the nip portion T3 may be measured in a stopped state. Here, the nip length is determined by the diameters of the cleaning roller 31 and the opposed roller 40, and the amount of deformation of the intermediate transfer belt 21. According to the present embodiment, the diameter of the cleaning roller 31 is 28 mm, and the diameter of the opposed roller 40 is 21 mm. Meanwhile, the surface roughness of the cleaning roller 31 and the opposed roller 40 is less than 0.2 μm according to the standard of JIS B 0031:2003. The surface roughness of these rollers can be measured using PU-OS400 (manufactured by Kosaka Laboratory, Ltd.).

Regarding the liquid thickness of the liquid developer, a portion of the liquid developer is peeled off from the surface of the intermediate transfer belt 21 that has passed through the nip portion T3 using a scraper or the like, and the difference of elevation between a site at which the liquid developer has been peeled off, and a site at which the liquid developer has not been peeled off, is actually measured using a confocal microscope or the like. Further, a value equivalent to twice the elevation difference thus measured is designated as the liquid thickness of the liquid developer. That is, the liquid developer at the nip portion T3 is separated into the intermediate transfer belt 21 and the cleaning roller 31 after passing through the nip portion T3. Therefore, the liquid thickness of the liquid developer on the surface of the intermediate transfer belt 21, which has passed through the nip portion T3, becomes a half of the liquid thickness of the liquid developer at the nip portion T3. Thus, since the elevation difference actually measured as described above becomes twice, the liquid thickness of the liquid developer at the nip portion T3 can be determined. Meanwhile, regarding the confocal microscope, for example, confocal microscope VK8700 (manufactured by Keyence Corporation) may be used.

Cleaning Nip Portion

As described above, in the present embodiment, in order to cause the toner to move from the intermediate transfer belt 21 to the cleaning roller 31 by electrophoresis by means of the liquid developer, it is necessary to form the nip portion T3 at the nip length L that satisfies the above-described Formula 1. In order to do so, in the present embodiment, the cleaning roller 31 and the opposed roller 40 are disposed such that the intermediate transfer belt 21 is wound around the cleaning roller 31. This will be explained using FIG. 5.

Figure 5:
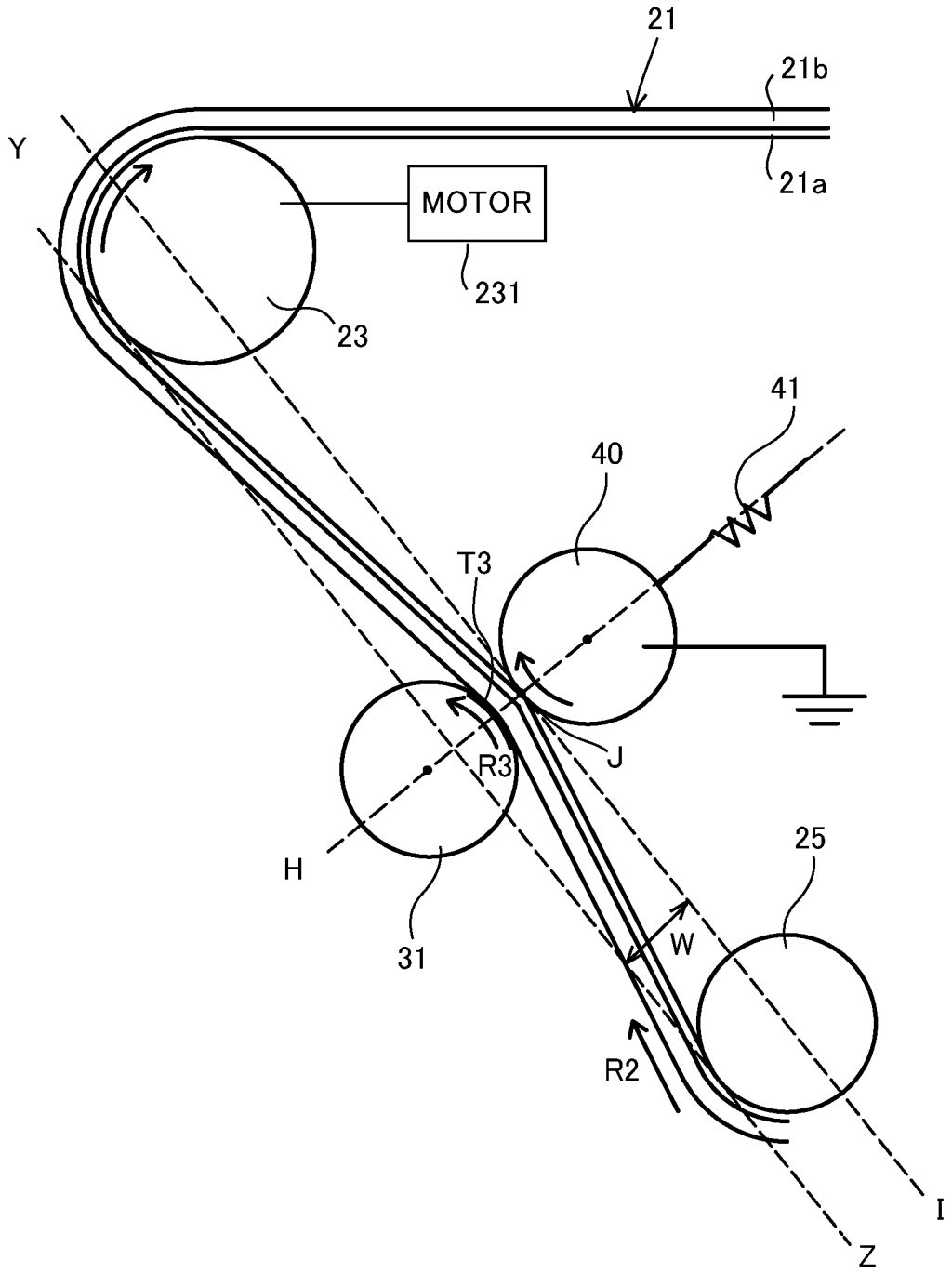
FIG. 5 is a schematic diagram illustrating the disposition of an opposed roller and a cleaning roller in the belt cleaning apparatus of the first embodiment.

As shown in FIG. 5, in the case of the present embodiment, the driving roller 23 is a roller that initially applies tension to the intermediate transfer belt 21 on the downstream side of the nip portion T3. That is, the driving roller 23 is a roller that initially applies tension to the intermediate transfer belt 21 on a further downstream side than the cleaning roller 31 and the opposed roller 40. This driving roller 23 is driven to rotate by a motor 231 serving as a second driving source. Then, the cleaning roller 31 bends the intermediate transfer belt 21 at the inner side of the belt, so as to push in the intermediate transfer belt 21 from the outer side to the inner side. The cleaning roller 31 projects the intermediate transfer belt 21 on a side further inward than the external common tangent Z on the intermediate transfer belt side (belt member side) among the external common tangents of the secondary transfer inner roller 25 and the driving roller 23. At least one roller between the driving roller 23 and the secondary transfer inner roller 25 is installed on the same side as the cleaning roller 31 with respect to tangential line I that passes through intersection point J between straight line H connecting the center of rotation of the opposed roller 40 with the center of rotation of the cleaning roller 31, and the opposed roller 40. In other words, this at least one roller is installed at a position that intrudes into region Y on the opposite side of the opposed roller 40 with respect to the tangential line I. Here, both the driving roller 23 and the secondary transfer inner roller 25 are installed so as to intrude into the region Y. In the case of the present embodiment, the driving roller 23 is a first roller that initially applies tension to the intermediate transfer belt 21 on the downstream side of the cleaning roller 31 and the opposed roller 40 in the moving direction. On the other hand, the secondary transfer inner roller 25 is a second roller that initially applies tension to the intermediate transfer belt 21 on the upstream side of the cleaning roller 31 and the opposed roller 40 in the moving direction. In other words, the driving roller 23 serves as the first roller adjacent to the cleaning roller 31 and the opposed roller 40 on a downstream side in the moving direction of the belt member 21 and is configured to tension the belt member 21 and the secondary transfer inner roller 25 serves as the second roller adjacent to the cleaning roller 31 and the opposed roller 40 on an upstream side in the moving direction of the belt member 21 and is configured to tension the belt member 21.

The cleaning roller 31 is fixed to be freely rotatable so as to compress the intermediate transfer belt 21 from the outer side toward the inner side. On the other hand, with regard to the opposed roller 40, the bearings (not shown in the diagram) supporting the opposed roller 40 at the two ends are energized by a pressing spring 41 such that the opposed roller 40 compresses the intermediate transfer belt 21 from the inner side toward the outer side by means of the pressing spring 41.

In a case in which the intermediate transfer belt 21 is bent, the winding amount of the intermediate transfer belt 21 about the cleaning roller 31 increases, compared to the case in which the intermediate transfer belt 21 is not bent. As described above, the nip portion T3 has a physical nip T3*b* and a tension nip T3*a* (see FIG. 2B), and as the winding amount of the intermediate transfer belt 21 increases, the tension nip T3*a* becomes longer. By lengthening the tension nip T3*a* as such, the nip length of the nip portion T3 can be adjusted to a length that satisfies the above-described Formula 1, and thereby the toner on the intermediate transfer belt 21 can be sufficiently removed by electrophoresis.

According to the present embodiment, the relationship between the nip length L required for subjecting the toner to electrophoresis and the electric field E can be represented by Formula 4, which is obtained by modifying the above-described Formula 1.

$$E>(d\times P/\mu)/L \qquad \text{Formula 4}$$

Figure 6:
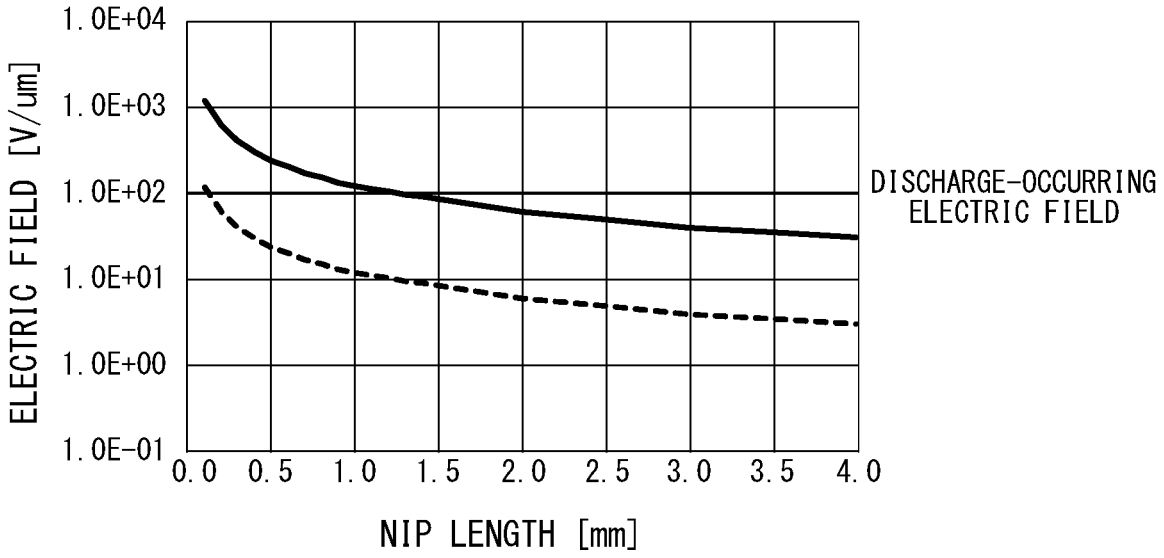
FIG. 6 is a graph showing the relationship between the strength of the electric field and the nip length.

Here, the relationship between the nip length and the strength of the electric field (electric field intensity) is shown in FIG. 6. In FIG. 6, the case in which the toner mobility is $1.00^{-11}$ ($m^2/(V\times s)$) is represented by a solid line, and the case in which the toner mobility is $1.00^{-10}$ ($m^2/(V\times s)$) is represented by a dotted line. What is exhibited by this graph is the lowest electric field intensity required for each nip length. For example, in a case in which the toner mobility is $1.00^{-10}$ ($m^2/(V\times s)$), when the nip length is 1.5 mm, the toner cannot move by electrophoresis if an electric field intensity of higher than about 1.0E+1 (V/μm) is not obtained. Therefore, when an electric field having an electric field intensity higher than or equal to that represented by each of the lines is obtained, the toner can move by electrophoresis at the nip portion T3. However, there is an upper limit in the electric field intensity. This is because when the electric field intensity is too high, discharge occurs in the vicinity of the nip portion T3, and cleanability is deteriorated. In the case of the present embodiment, since discharge occurs at an electric field intensity of higher than 1.0E+2 (V/μm), the electric field intensity is 1.0E+2 (V/μm) or lower.

Meanwhile, in the case of the present embodiment, the toner mobility may be adjusted to be $1.00^{-11}$ ($m^2/(V\times s)$). It is because the toner mobility can be decreased concomitantly with use; however, in a case in which the toner mobility satisfies the lower limit, the cleanability achieved by the belt cleaning apparatus 30 is guaranteed.

Next, an experiment of comparing the cleaning performance in relation to the case in which the intermediate transfer belt 21 was bent as described above and the case in which the intermediate transfer belt 21 was not bent, was carried out using either a metal roller or a rubber roller for the cleaning roller 31 and the opposed roller 40. The experiment results are presented in Table 1. The cleaning roller 31 used for the experiment has a diameter of 28 mm, and the opposed roller 40 has a diameter of 21 mm. Furthermore, the rubber roller is such that the thickness of the elastic layer formed from urethane rubber is 2 mm, and its Young's modulus is 0.3 (MPa). Meanwhile, a first example, a second example, and a fourth example that will be described below are Comparative Examples, and a third example and a fifth example correspond to the present embodiments.

TABLE 1

| Cleaning roller | Opposed roller | Nip length [mm] | Projection amount of cleaning roller [mm] | Electric field [V/μm] | Cleaning performance |
|---|---|---|---|---|---|
| Rubber | Rubber | 1.5 | 0 | 85 | GOOD |
| Metal | Rubber | 0.8 | 0 | 115 | POOR |
| | | 1.5 | 5 | 85 | GOOD |
| Metal | Metal | 0.3 | 0 | 300 | POOR |
| | | 1.5 | 7 | 85 | GOOD |

As the first example, in a case in which the cleaning roller 31 and the opposed roller 40 are both rubber rollers, and the projection quantity of the cleaning roller 31 is "0 mm", a nip portion T3 having a nip length of "1.5 mm" is formed. Here, the projection quantity of the cleaning roller 31 is the distance between the external common tangent Z on the intermediate transfer belt side and the farthest close contact position from the external common tangent Z among the close contact positions between the cleaning roller 31 and the intermediate transfer belt 21 in the nip portion T3 (represented by symbol W in FIG. 5). That is, in a case in which the intermediate transfer belt 21 is not bent, the projection quantity of the cleaning roller 31 is "0". In this case, as shown in Table 1, satisfactory cleaning performance with an electric field intensity of 85 (V/μm) is obtained.

As the second example, in a case in which the cleaning roller 31 is a metal roller, the opposed roller 40 is a rubber roller, and the projection quantity of the cleaning roller 31 is "0", a nip portion T3 having a nip length of "0.8 mm" is formed. In this case, as shown in Table 1, even if the electric field intensity was increased (115 (V/μm)) relative to the first example, satisfactory cleaning performance could not be obtained. This is because a metal roller is not easily deformed compared to a rubber roller, only a short nip length is obtained compared to the first example, and a nip portion T3 cannot be secured to the extent that can form a liquid layer of the liquid developer sufficient for moving the toner by electrophoresis. Thus, as a third example, the projection quantity of the cleaning roller 31 was set to "5 mm", in other words, the intermediate transfer belt 21 was bent, a nip length of "1.5 mm" that was equal to the first example was secured. By securing a nip length of "1.5 mm", as shown in Table 1, satisfactory cleaning performance is obtained at an electric field intensity of 85 (V/μm).

As a fourth example, in a case in which the cleaning roller 31 and the opposed roller 40 are both metal rollers, and the projection quantity of the cleaning roller 31 is "0", a nip portion T3 having a nip length of "0.3 mm" is formed. In this case, as shown in Table 1, even if the electric field intensity was increased to a large extent (300 (V/μm)) compared to the first example, satisfactory cleaning performance was not obtained. This is because when metal rollers are used in combination, only a shorter nip length is obtained, and a nip portion T3 cannot be secured to the extent that can form a liquid layer of the liquid developer sufficient for moving the toner by electrophoresis. Furthermore, it is because the electric field intensity is too high, and therefore, discharge may occur. Thus, as a fifth example, the projection quantity of the cleaning roller 31 is adjusted to be "7 mm" that is larger than the third example. In this way, a nip length of "1.5 mm" that is equal to the first example can be secured, and as shown in Table 1, satisfactory cleaning performance is obtained at an electric field intensity of 85 (V/μm).

However, as described above, in a case in which the intermediate transfer belt 21 is bent, the surface velocity on the outer peripheral side (front surface) of the intermediate transfer belt 21 can become less than the surface velocity on the inner peripheral side (rear surface), as the elastic layer 21*b* is compressed in the moving direction of the intermediate transfer belt 21 at the nip portion T3. In this case, due to the relative velocity difference with the cleaning roller 31, strain occurs in the elastic layer 21*b* of the intermediate transfer belt 21 at the nip portion T3, and when this strain exceeds the limit, the intermediate transfer belt 21 may instantaneously change. At that time, winding of the intermediate transfer belt 21 by means of the driving roller 23 is likely to become loose. Thus, in a case in which the intermediate transfer belt 21 is caused to project on the inner side, it is important to prevent the intermediate transfer belt 21 from loosening. Therefore, in the present embodiment, the cleaning roller 31 is rotated such that the surface velocity thereof becomes slower than the surface velocity of the intermediate transfer belt 21 at the nip portion T3, and thus the relative velocity difference between the intermediate transfer belt 21 and the cleaning roller 31 is reduced. In the following description, this will be described with reference to FIG. 5.

The elastic layer 21*b* of the intermediate transfer belt 21 is compressed in the thickness direction of the belt by means of the cleaning roller 31 and the opposed roller 40 at the nip portion T3. Here, the thickness t of the intermediate transfer belt 21 at the nip portion T3 can be represented by the following Formula 5, in a case in which the radius of the cleaning roller 31 is designated as r, the radius of the opposed roller 40 is designated as s, and the distance between the center of rotation of the cleaning roller 31 and the center of rotation of the opposed roller 40 is designated as x.

$$t=x-r-s \qquad \text{Formula 5}$$

The surface velocity u on the outer peripheral side of the intermediate transfer belt 21 at the nip portion T3 can be represented by the following Formula 6, in a case in which the surface velocity of the driving roller 23 is v1, from the relationship of the radius ratio based on the winding of the intermediate transfer belt 21 around the cleaning roller 31.

$$u=r/(r+t)\times v1 \qquad \text{Formula 6}$$

When Formula 5 is substituted into the above-described Formula 6, Formula 7 is obtained.

$$u=r/(x-s)\times v1 \quad \text{Formula 7}$$

When the cleaning roller 31 is rotated so as to satisfy the relationship (v2<u) that the surface velocity of the cleaning roller 31 (designated as v2) is slower than the surface velocity u of the intermediate transfer belt 21, the intermediate transfer belt 21 receives frictional force on the opposite side in the moving direction at the nip portion T3. In this case, a state in which the intermediate transfer belt 21 is pulled toward the driving roller 23 is achieved, and the relative velocity difference between the intermediate transfer belt 21 and the cleaning roller 31 is reduced at the nip portion T3. Then, winding of the intermediate transfer belt 21 by the driving roller 23 is not easily loosened. Furthermore, in order to satisfy the cleaning performance by electrophoresis, as described above, it is desirable that the relative velocity between the surface velocity of the intermediate transfer belt 21 and the surface velocity of the cleaning roller 31 is within ±10%. From the above description, in the case of the present embodiment, it is preferable that the cleaning roller 31 is rotated so as to satisfy the following Formula 8. That is, when the cleaning roller 31 is rotated so as to satisfy the relationship of Formula 8, stable cleaning performance and belt running performance are attained.

$$r/(x-s)-0.1<v2/v1<r/(x-s) \quad \text{Formula 8}$$

As described above, in the present embodiment, the intermediate transfer belt 21 is bent by pushing in the intermediate transfer belt 21 from the outer side to the inner side by the cleaning roller 31 so that a nip portion T3 can be secured to the extent that a liquid layer of the liquid developer sufficient for moving the toner by electrophoresis can be formed. Thereby, the nip length of the nip portion T3 can be adjusted to a length over which the toner on the intermediate transfer belt 21 can be sufficiently moved by electrophoresis (see the above-described Formula 1). Furthermore, in the present embodiment, the cleaning roller 31 is rotated such that the surface velocity thereof becomes slower than the surface velocity of the intermediate transfer belt 21 at the nip portion T3. Thereby, in a case in which a nip portion T3 sufficient for sufficiently removing the toner on the intermediate transfer belt 21 by electrophoresis is secured, loosening of the winding of the intermediate transfer belt 21 concomitant to rotary driving of the cleaning roller 31 and the driving roller 23 can be suppressed. That is, according to the present embodiment, an image forming apparatus that includes a cleaning roller and a driving roller that are respectively subjected to rotary driving and forms an image using a liquid developer, is provided, and loosening of the belt member to which tension is applied between the driving roller and the cleaning roller can be suppressed, while a nip amount between the cleaning roller and the belt member is secured. Furthermore, in the present embodiment, the driving roller 23 is a roller that initially applies tension to the intermediate transfer belt 21 on the downstream side of the cleaning roller 31 in the belt moving direction; however, the driving roller is not limited to this. For example, another tension-applying roller may be provided between the driving roller 23 and the cleaning roller 31.

Second Embodiment

A second embodiment will be described using FIG. 7A and FIG. 8. The second embodiment disclosed herein is intended to form a nip portion T3 having a longer nip length compared to the first embodiment, by having the cleaning roller 31 and the opposed roller 40 disposed with an offset, unlike the first embodiment described above. Hereinafter, the same reference symbols will be assigned to configurations similar to the first embodiment described above, and further explanation and depiction will be omitted or simplified, while the second embodiment will be described mainly based on parts that are different from the first embodiment.

Figure 7A:
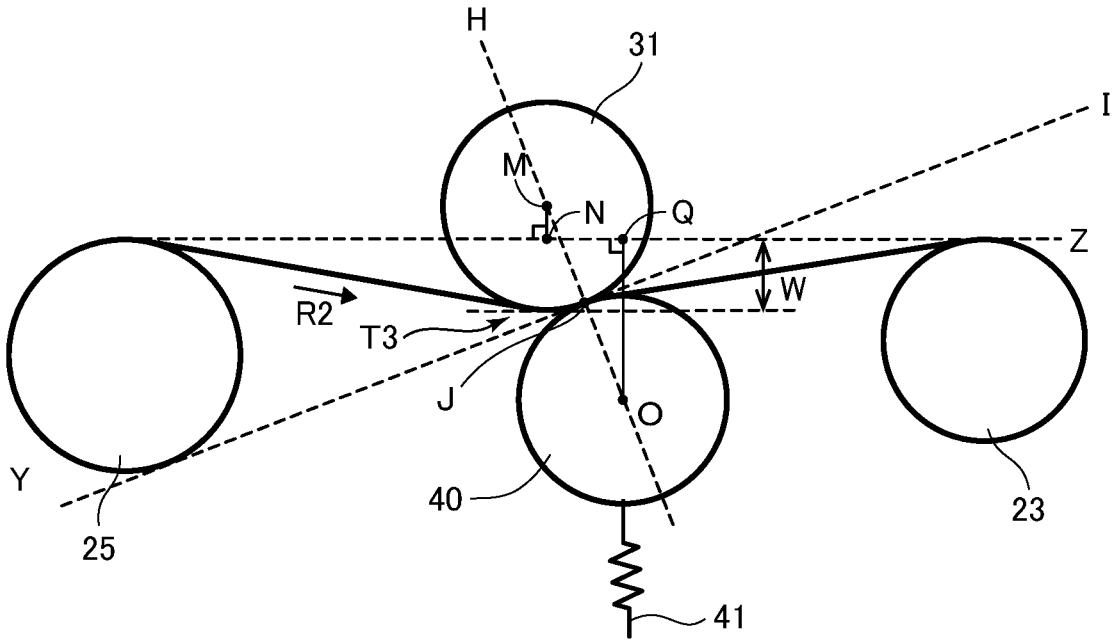
FIG. 7A is a schematic diagram illustrating the disposition of an opposed roller and a cleaning roller in a belt cleaning apparatus of a second embodiment.
Figure 8:
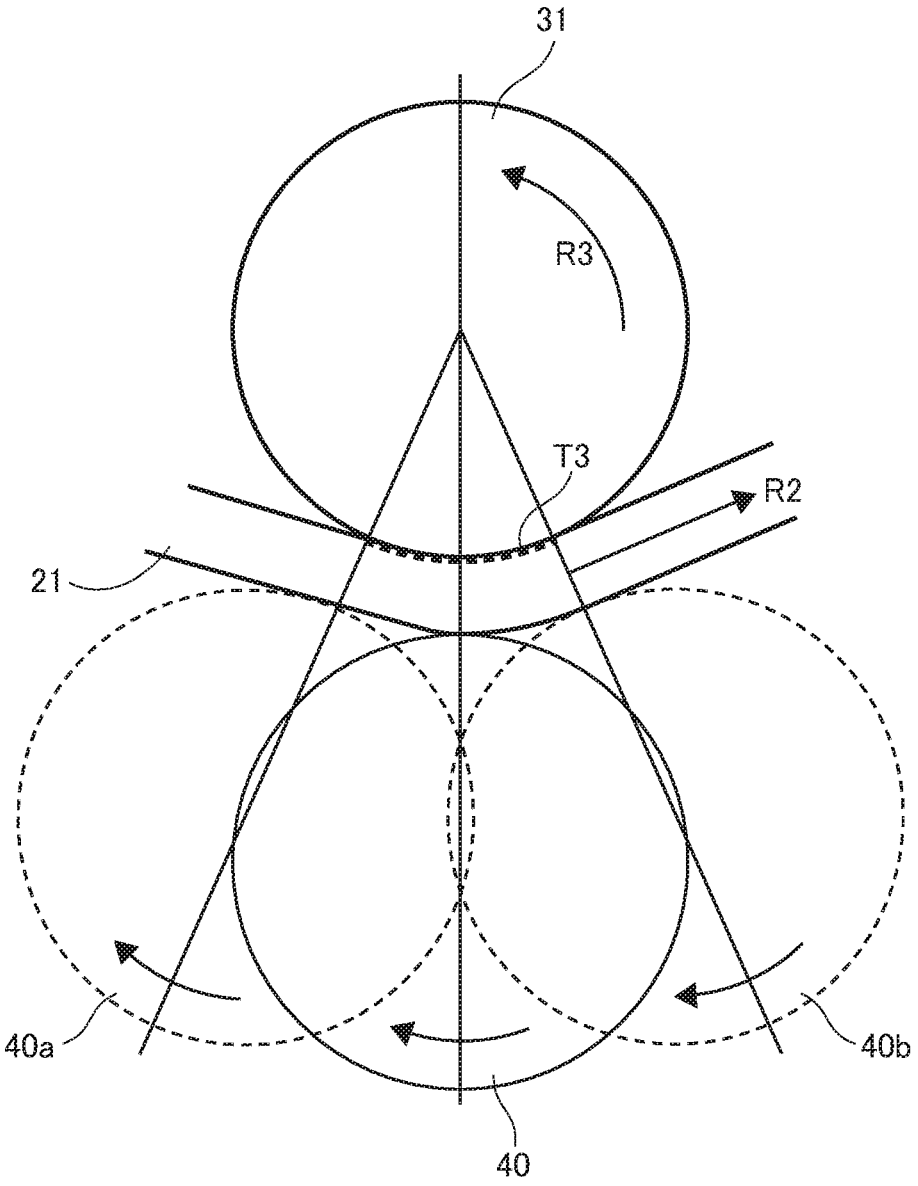
FIG. 8 is a schematic diagram explaining the offset of the opposed roller and the cleaning roller.

As shown in FIG. 7A, also in the present embodiment, similarly to the first embodiment, the cleaning roller 31 projects the intermediate transfer belt 21 further on an inner side than the external common tangent Z on the intermediate transfer belt side among the external common tangents of the secondary transfer inner roller 25 and the driving roller 23. At least one roller between the driving roller 23 and the secondary transfer inner roller 25 is installed at a position that intrudes into a region Y on the opposite side of the opposed roller 40 with respect to tangential line I that passes through intersection point J between straight line H connecting the center of rotation of the opposed roller 40 with the center of rotation of the cleaning roller 31, and the opposed roller 40. Here, the secondary transfer inner roller 25 is installed at a position that intrudes into the region Y.

Furthermore, unlike the first embodiment, the cleaning roller 31 and the opposed roller 40 are disposed with an offset. That is, the cleaning roller 31 is disposed such that a first intersection point N of the external common tangent Z and a perpendicular line passing through the center of rotation M of the cleaning roller 31, and a second intersection point Q of the external common tangent Z and a perpendicular line passing through the center of rotation O of the opposed roller 40, are shifted in the moving direction. However, in the case of the present embodiment, the central position of a physical nip T3*b* in the moving direction is disposed on the downstream side of the central position of the nip portion T3 in the moving direction (see FIG. 7B). Then, the cleaning roller 31 presses the intermediate transfer belt 21 from the outer side toward the inner side, and the opposed roller 40 presses the intermediate transfer belt 21 from the inner side toward the outer side by means of a pressing spring 41. Meanwhile, the cleaning roller 31 and the opposed roller 40 are disposed with an offset to the extent that a physical nip T3*b* is formed. By forming the physical nip T3*b*, discharge can be suppressed.

Figure 7B:
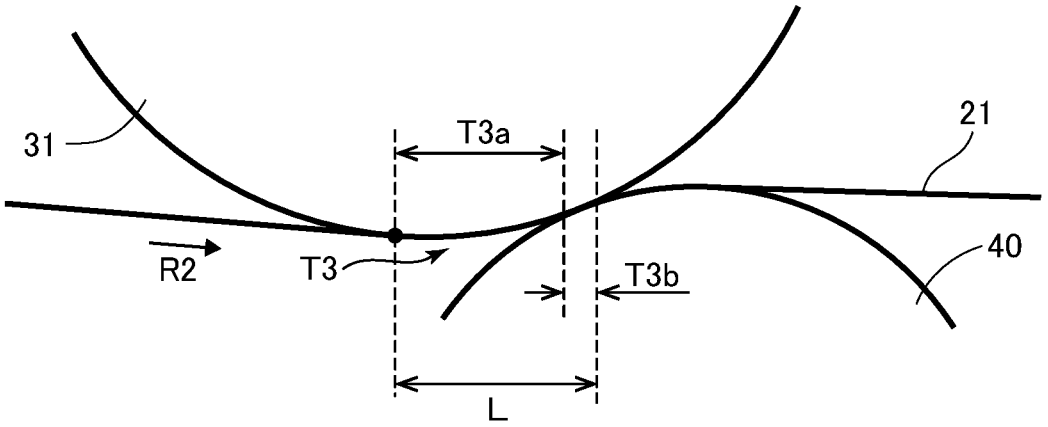
FIG. 7B is a magnified diagram illustrating a nip portion in the belt cleaning apparatus of the second embodiment.

When the cleaning roller 31 and the opposed roller 40 are disposed with an offset, a nip portion T3 having a nip length that satisfies the above-described Formula 1 can be formed even without making the projection quantity of the cleaning roller 31 larger compared to the above-described first embodiment. That is, as shown in FIG. 7B, the winding amount of the intermediate transfer belt 21 around the cleaning roller 31 is increased by the disposition with an offset, and the tension nip T3*a* can be made longer. When the tension nip T3*a* is made longer, and the nip length of the nip portion T3 is adjusted to a length that satisfies the above-described Formula 1, the toner on the intermediate transfer belt 21 can be sufficiently removed by electrophoresis. The second embodiment as such is particularly effective in a case in which the cleaning roller 31 and the opposed roller 40 are both a metal roller.

Then, as shown in FIG. 7A and FIG. 7B, in the case of the present embodiment, it is preferable that the cleaning roller 31 is disposed so as to be in close contact with the intermediate transfer belt 21 upstream of the opposed roller 40 in the moving direction of the intermediate transfer belt 21. That is, it is preferable that the cleaning roller 31 is disposed such that the first intersection point N is positioned upstream of the second intersection point Q in the moving direction of the intermediate transfer belt 21, with respect to the opposed roller 40. This is because a decrease in the cleaning performance caused by the occurrence of discharge is suppressed.

The above-described discharge will be described using FIG. 8 with reference to FIG. 7B. Meanwhile, in FIG. 8, the case in which the cleaning roller 31 is not disposed with an offset with respect to the opposed roller 40 (see FIG. 5) is also depicted. In the present embodiment, as described above, the tension nip T3*a* is lengthened by disposing the cleaning roller 31 and the opposed roller 40 with an offset. Then, the path of the electric current flowing from the cleaning roller 31 to the intermediate transfer belt is broadened; however, depending on the position of the opposed roller 40, the path of the electric current is narrowed. As shown in FIG. 8, in a case in which the cleaning roller 31 is disposed with an offset on the downstream side of the opposed roller 40*a* in the moving direction, discharge is likely to occur. That is, in this case, the electric current is concentrated from the intermediate transfer belt 21 toward the opposed roller 40*a* in a state in which charge injection from the cleaning roller 31 to the intermediate transfer belt 21 occurs to a reduced extent. Particularly, the potential difference between the surface of the cleaning roller 31 and the surface of the intermediate transfer belt 21 becomes large at the physical nip T3*b* on the upstream side of the intermediate transfer belt 21 in the moving direction, and discharge may occur on the upstream side of the moving direction. In this case, since the upstream side in the moving direction is still in a state in which a large amount of the toner still remains on the cleaning roller 31 side, the influence exerted by discharge on the cleaning performance is large.

On the other hand, when the cleaning roller 31 is disposed with an offset on the upstream side of the opposed roller 40*b* in the moving direction, discharge does not easily occur on the upstream side in the moving direction. That is, in this case, since charge injection from the cleaning roller 31 to the intermediate transfer belt 21 occurs at the tension nip T3*a*, the electric current is concentrated from the intermediate transfer belt 21 toward the opposed roller 40*b* at the physical nip T3*b*. In that case, the potential difference between the surface of the cleaning roller 31 and the surface of the intermediate transfer belt 21 does not become large on the upstream side in the moving direction of the intermediate transfer belt 21, and discharge does not easily occur. Furthermore, in this case, for example, even if discharge occurs at the physical nip T3*b* on the downstream side in the moving direction of the intermediate transfer belt 21, since the occurrence of discharge comes after most of the toner has already moved to the cleaning roller 31 side, the influence exerted on the cleaning performance is negligible.

In Table 2, results obtained by comparing the cleaning performance in the case in which the cleaning roller 31 and the opposed roller 40 are disposed with an offset on the upstream side in the moving direction and on the downstream side in the moving direction, respectively. Furthermore, for reference, the cleaning performance is shown also with regard to the case in which the cleaning roller 31 is not disposed with an offset with respect to the opposed roller 40 (middle in Table 2).

TABLE 2

| Position of cleaning roller | Nip length [mm] | Presence or absence of discharge on upstream side | Cleaning residue concentration |
|---|---|---|---|
| Downstream side | 1.5 | Present | 0.008 |
| Middle | 1.5 | Absent | 0.003 |
| Upstream side | 1.5 | Absent | 0.003 |

As can be understood from Table 2, in a case in which the cleaning roller 31 and the opposed roller 40 are disposed with an offset, satisfactory cleaning performance is obtained when the cleaning roller 31 is disposed with an offset on the upstream side of the opposed roller 40*b* in the moving direction. In contrast, when the cleaning roller 31 is disposed with an offset on the downstream side of the opposed roller 40*b* in the moving direction, discharge occurs on the upstream side in the moving direction as described above, and a slight amount of toner residue is generated. The concentration of the toner residue was measured with a concentration meter manufactured by X-Rite, Inc., and the concentration was about 0.008. This shows that the cleaning performance is degraded compared to the case in which the concentration of the toner residue is about 0.003 or less, and the cleaning roller 31 is disposed with an offset on the upstream side of the opposed roller 40*b* in the moving direction.

As described above, in the second embodiment, a nip portion T3 sufficient for sufficiently moving the toner on the intermediate transfer belt 21 by electrophoresis can be easily secured by disposing the cleaning roller 31 and the opposed roller 40*b* with an offset. Particularly, when the cleaning roller 31 is disposed with an offset on the upstream side of the opposed roller 40*b* in the moving direction, more satisfactory cleaning performance can be obtained. Furthermore, even in this case, similarly to the above-described first embodiment, the cleaning roller 31 is rotated such that the surface velocity thereof becomes slower than the surface velocity of the intermediate transfer belt 21 at the nip portion T3. Therefore, in the second embodiment, even in a case in which a larger nip portion T3 for removing the toner on the intermediate transfer belt 21 by electrophoresis is secured, loosening of the intermediate transfer belt 21 concomitant to the rotary driving of the cleaning roller 31 and the driving roller 23 can be suppressed.

Third Embodiment

In the first embodiment and second embodiment described above, an example of bending the intermediate transfer belt 21 by pushing in the intermediate transfer belt 21 from the outer side to the inner side by means of the cleaning roller 31 is disclosed; however, the example is not limited to this. For example, the intermediate transfer belt 21 may be bent by pushing in the intermediate transfer belt 21 from the inner side to the outer side by means of the opposed roller 40. The third embodiment as such will be described using FIG. 9. Meanwhile, also in the present embodiment, the same reference symbols will be assigned to configurations similar to the first embodiment described above, and further explanation and depiction will be omitted or simplified, while the third embodiment will be described mainly based on parts that are different from the first embodiment.

Figure 9:
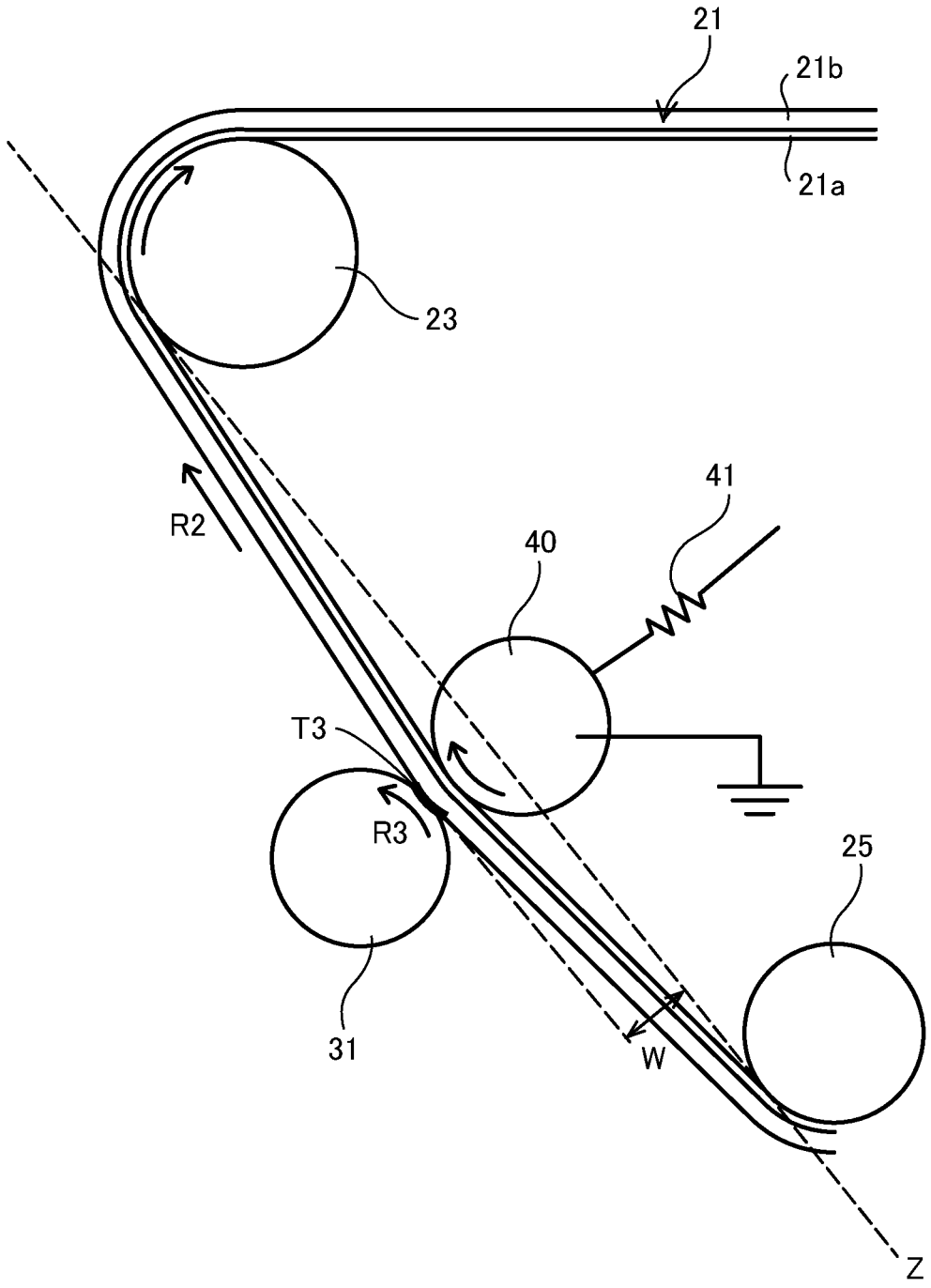
FIG. 9 is a schematic diagram illustrating the disposition of an opposed roller and a cleaning roller in a belt cleaning apparatus of a third embodiment.

As shown in FIG. 9, in the case of the present embodiment, the intermediate transfer belt 21 is bent on the outer side of the belt by pushing in the intermediate transfer belt 21 from the inner side to the outer side by the opposed roller 40. The opposed roller 40 presses the intermediate transfer belt 21 from the inner side toward the outer side by means of a pressing spring 41. On the other hand, the cleaning roller 31 is fixed to be freely rotatable so as to compress the intermediate transfer belt 21 from the outer side toward the inner side. The opposed roller 40 can project the intermediate transfer belt 21 on a side further outward than the external common tangent Z on the intermediate transfer belt side among the external common tangents of the secondary transfer inner roller 25 and the driving roller 23. Meanwhile, in the case of the present embodiment, unlike the case of the first and second embodiments described above, since the elastic layer 21*b* is not easily subjected to the compressive stress exerted by the cleaning roller 31, the lifetime of the intermediate transfer belt 21 can be made long compared to the first and second embodiments.

In the case of the present embodiment, compared to the first embodiment described above, a nip portion T3 is secured by subjecting the elastic layer 21*b* to greater elastic deformation by using a cleaning roller 31 having a larger diameter, making the welding pressure of the opposed roller 40 greater, or the like. In that case, since the elastic layer 21*b* is expanded as the intermediate transfer belt 21 is wound around the opposed roller 40 at the nip portion T3, the surface velocity on the outer peripheral side (front surface) of the intermediate transfer belt 21 may become greater than the surface velocity of the inner peripheral side (rear surface). In this case, due to the strain in the elastic layer 21*b* of the intermediate transfer belt 21 occurring at the nip portion T3 as a result of the velocity difference between the intermediate transfer belt 21 and the cleaning roller 31, the intermediate transfer belt 21 between the cleaning roller and the driving roller 23 may become loose. Thus, even in a case in which the intermediate transfer belt 21 is projected on the outer side, it is important not to make the intermediate transfer belt 21 loose. From this point of view, in the present embodiment, the cleaning roller 31 is rotated such that the surface velocity thereof is slower than the surface velocity of the intermediate transfer belt 21 at the nip portion T3. Hereinafter, this point will be explained with reference to FIG. 9.

The elastic layer 21*b* of the intermediate transfer belt 21 is compressed in the thickness direction of the belt by the cleaning roller 31 and the opposed roller 40 at the nip portion T3. The thickness t of the intermediate transfer belt 21 at the nip portion T3 can be represented by the above-described Formula 5 (t=x−r−s), in a case in which the radius of the cleaning roller 31 is designated as r; the radius of the opposed roller 40 is designated as s; and the distance between the center of rotation of the cleaning roller 31 and the center of rotation of the opposed roller 40 is designated as x.

The surface velocity u on the outer peripheral side of the intermediate transfer belt 21 at the nip portion T3 can be represented by the following Formula 9, in a case in which the surface velocity of the driving roller 23 is V1, from the relationship of the radius ratio based on the winding of the intermediate transfer belt 21 around the opposed roller 40.

$$u=(s+t)/s\times v1 \qquad \text{Formula 9}$$

When Formula 5 is substituted into the above-described Formula 9, Formula 10 is obtained.

$$u=(x-r)/s\times v1 \qquad \text{Formula 10}$$

Then, the cleaning roller 31 is rotated so as to satisfy the relationship (v2<u) that the surface velocity thereof (designated as v2) is slower than the surface velocity u of the intermediate transfer belt 21. Hereupon, a state in which the intermediate transfer belt 21 is pulled by the driving roller 23 is achieved, and the relative velocity difference between the intermediate transfer belt 21 and the cleaning roller 31 at the nip portion T3 is reduced. Then, the winding of the intermediate transfer belt 21 by the driving roller 23 does not easily become loose. Furthermore, it is desirable that the relative velocity between the surface velocity of the intermediate transfer belt 21 and the surface velocity of the cleaning roller 31 is within ±10%, as described above. From the above description, in the case of the present embodiment, it is preferable that the cleaning roller 31 is rotated so as to satisfy the following Formula 11. That is, when the cleaning roller 31 is rotated so as to satisfy the relationship of Formula 11, stable cleaning performance and belt running performance are obtained.

$$(x-r)/s-0.1<v2/v1<(x-r)/s \qquad \text{Formula 11}$$

As described above, in the present embodiment, the intermediate transfer belt 21 is bent by pushing in the intermediate transfer belt 21 from the inner side to the outer side by means of the cleaning roller 31, so that a nip portion T3 can be secured to the extent that a liquid layer of the liquid developer sufficient for moving the toner by electrophoresis can be formed. In this case, the cleaning roller 31 is rotated such that the surface velocity thereof is slower than the surface velocity of the intermediate transfer belt 21 at the nip portion T3. Thereby, loosening of the intermediate transfer belt 21 concomitant to rotary driving of the cleaning roller 31 and the driving roller 23 can be suppressed.

Fourth Embodiment

Figure 10:
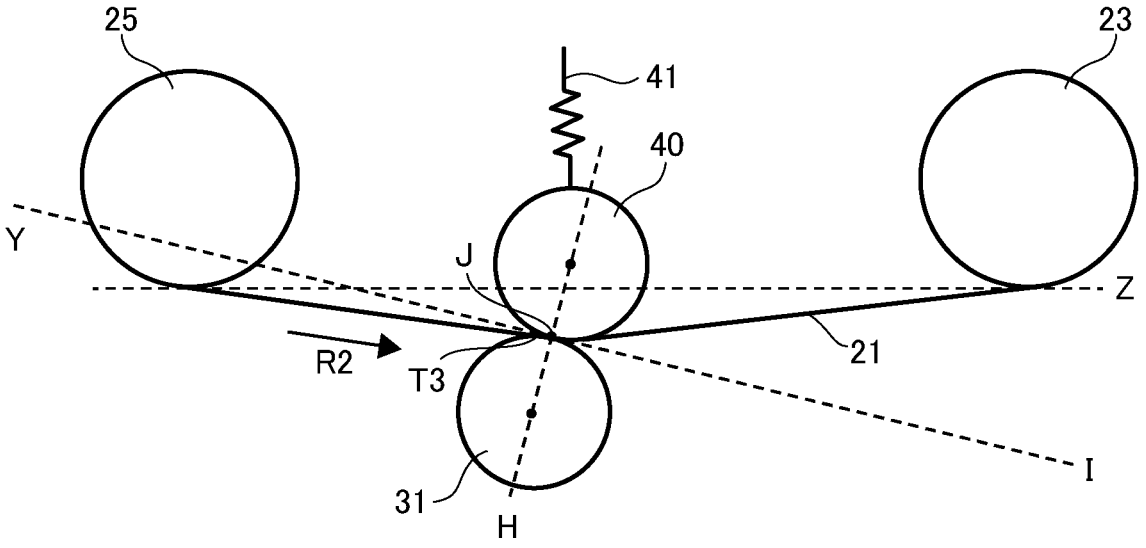
FIG. 10 is a schematic diagram illustrating the disposition of an opposed roller and a cleaning roller in a belt cleaning apparatus of a fourth embodiment.

Also in the third embodiment described above, similarly to the second embodiment described above, the cleaning roller 31 and the opposed roller 40*b* may be disposed with an offset in a state in which a physical nip T3*b* is formed (see FIG. 7B). FIG. 10 shows such a fourth embodiment. As shown in FIG. 10, at least one roller between the driving roller 23 and the secondary transfer inner roller 25 are installed at a position that intrudes into a region Y on the opposite side of the opposed roller 40 with respect to tangential line I that passes through intersection point J between straight line H connecting the center of rotation of the opposed roller 40 with the center of rotation of the cleaning roller 31, and the opposed roller 40. Here, the secondary transfer inner roller 25 is installed at a position that intrudes into the region Y. In this way, by disposing the cleaning roller 31 and the opposed roller 40 with an offset, a nip portion T3 sufficient for sufficiently moving the toner on the intermediate transfer belt 21 by electrophoresis can be easily secured. Furthermore, when the cleaning roller 31 is disposed with an offset on the upstream side of the opposed roller 40 in the moving direction, more satisfactory cleaning performance can be obtained compared to the case in which the cleaning roller 31 is disposed with an offset on the downstream side in the moving direction. Even in this case, similarly to the third embodiment described above, the cleaning roller 31 is rotated such that the surface velocity thereof is slower than the surface velocity of the driving roller 23. By doing so, loosening of the intermediate transfer belt 21 concomitant to rotary driving of the cleaning roller 31 and the driving roller 23 can be easily suppressed, while providing a nip portion T3 sufficient for sufficiently removing the toner on the intermediate transfer belt 21 by electrophoresis.

Fifth Embodiment

In the first to fourth embodiments described above, an example of subjecting the driving roller 23 to rotary driving by means of a motor 231 is disclosed (see FIG. 5); however, the example is not limited to this. For example, the intermediate transfer belt 21 may be rotated by rotary-driving the secondary transfer inner roller 25 without rotary-driving the driving roller 23. That is, there is also a case in which the secondary transfer inner roller 25 also functions as a driving roller. A fifth embodiment in such a case will be described using FIG. 11. Meanwhile, also for the present embodiment, the same reference symbols will be assigned to configurations similar to the above-described first embodiment, and further explanation and depiction will be omitted or simplified, while the fifth embodiment will be described mainly based on parts that are different from the first embodiment.

Figure 11:
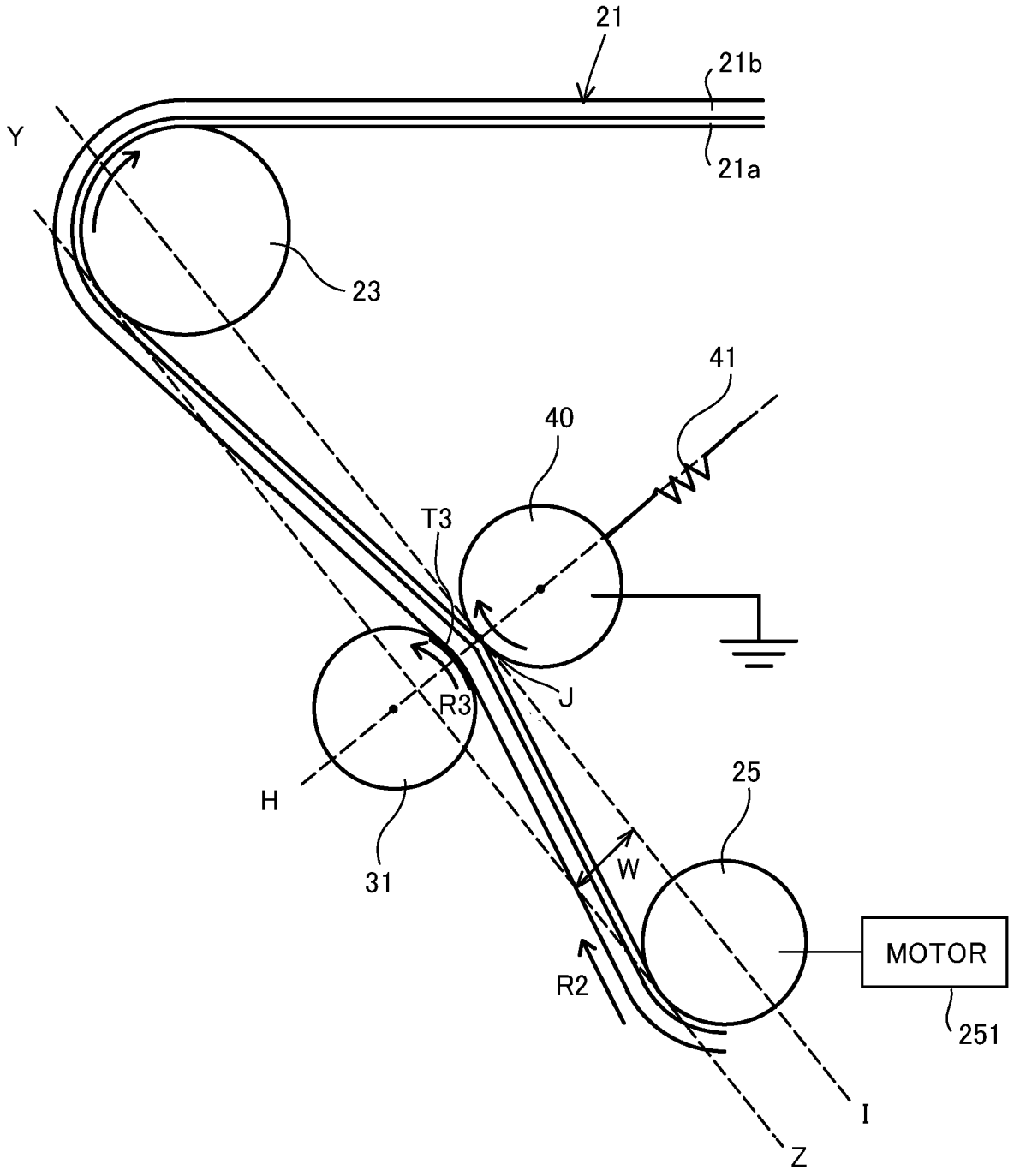
FIG. 11 is a schematic diagram illustrating a belt cleaning apparatus of a fifth embodiment.

As shown in FIG. 11, the secondary transfer inner roller 25 is subjected to rotary driving by means of a motor 251. In the case of the present embodiment, the cleaning roller 31 is rotated so as to satisfy the relationship (v2>u) that the surface velocity thereof (designated as v2) is faster than the surface velocity u of the intermediate transfer belt 21. In this case, a state in which the intermediate transfer belt 21 is pulled toward the secondary transfer inner roller 25 is achieved, and the relative velocity difference between the intermediate transfer belt 21 and the cleaning roller 31 is reduced at the nip portion T3. Then, the winding of the intermediate transfer belt 21 by the secondary transfer inner roller 25 does not easily become loose. Furthermore, it is desirable that the relative velocity between the surface velocity of the intermediate transfer belt 21 and the surface velocity of the cleaning roller 31 is within ±10% in order to satisfy the cleaning performance by electrophoresis, as described above. From the above description, in the case of the present embodiment, it is preferable that the cleaning roller 31 is rotated so as to satisfy the following Formula 12 according to the above-described Formula 5 to Formula 7. That is, when the cleaning roller 31 is rotated so as to satisfy the relationship of Formula 12, stable cleaning performance and belt running performance are obtained. Here, the surface velocity of the secondary transfer inner roller 25 is designated as "v1".

$$r/(x-s)+0.1>v2/v1>r/(x-s) \qquad \text{Formula 12}$$

Thereby, even in a case in which the secondary transfer inner roller 25 also functions as a driving roller, loosening of the intermediate transfer belt 21 concomitant to the rotary driving of the cleaning roller 31 and the secondary transfer inner roller 25 can be easily suppressed.

Other Embodiments

Figure 12:
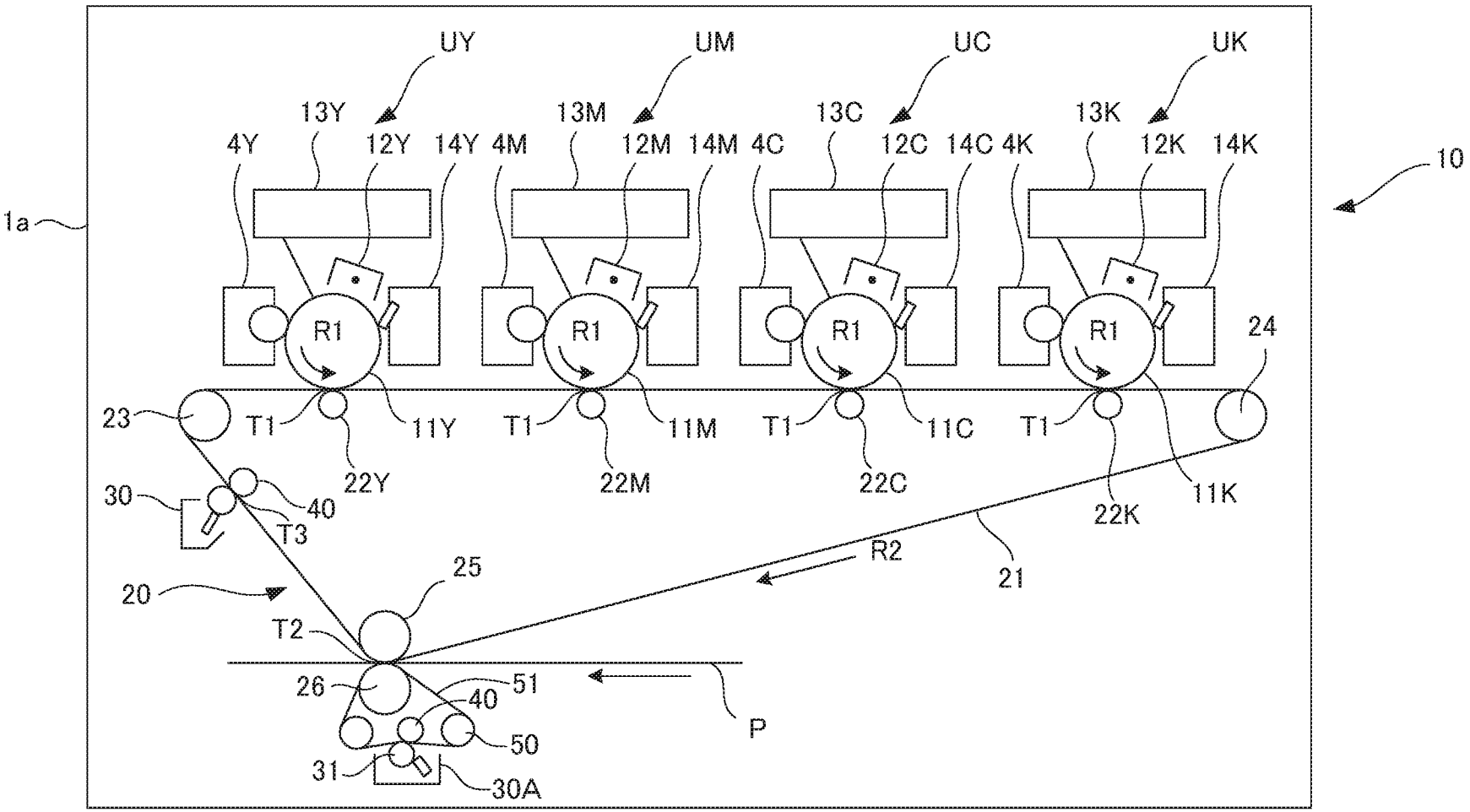
FIG. 12 is a schematic diagram illustrating the configuration of an image forming apparatus equipped with a secondary transfer unit.

The belt cleaning apparatuses 30 of the first to fifth embodiments described above can be applied to a two-roller belt cleaning apparatus for cleaning a secondary transfer belt. Hereinafter, the apparatus will be described using FIG. 12. As shown in FIG. 12, in order to subject a toner image that has been transferred onto the intermediate transfer belt 21 to secondary transfer onto a recording material P, an image forming apparatus including a secondary transfer unit 50 has been suggested. The secondary transfer unit 50 has an endless secondary transfer belt 51 that is installed to be freely rotatable such that tension is applied thereto by a plurality of rollers including a secondary transfer outer roller 26. Regarding the secondary transfer belt 51 serving as a belt member, an elastic belt having an elastic layer similarly to the above-mentioned intermediate transfer belt 21 is employed. Further, in order to remove the toner on the secondary transfer belt 51 (on secondary transfer belt) together with the carrier liquid, a two-roller belt cleaning apparatus 30A is disposed. Since the two-roller belt cleaning apparatus 30A may be similar to the belt cleaning apparatus 30 of the first to fifth embodiments described above, further description will not be given here.

Figure 13A:
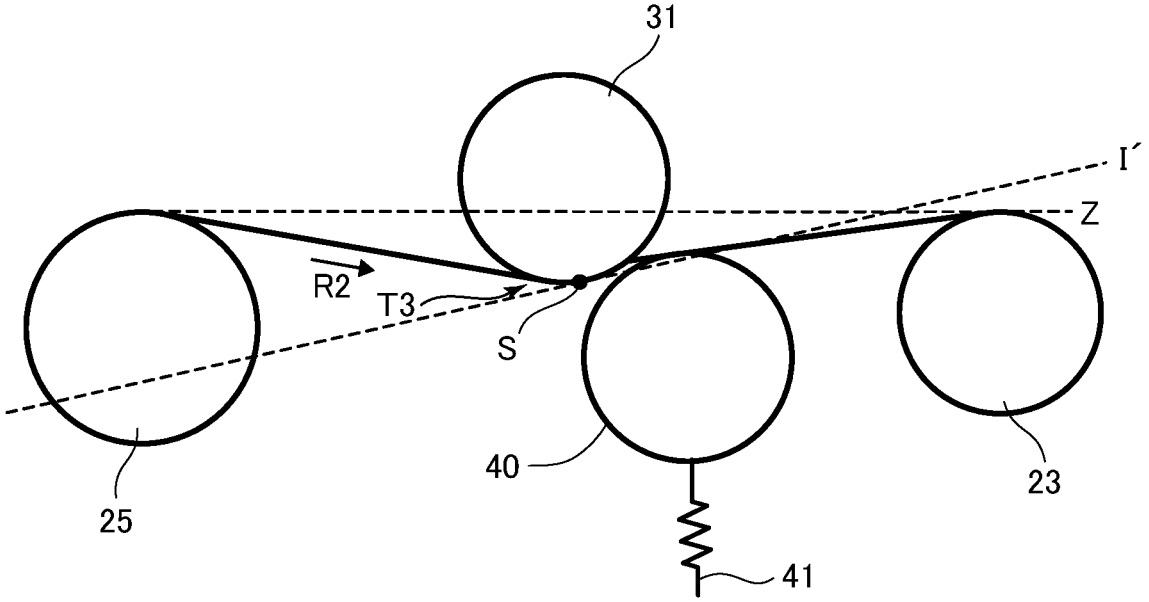
FIG. 13A is a schematic diagram illustrating the disposition of an opposed roller and a cleaning roller in a belt cleaning apparatus of another embodiment.
Figure 13B:
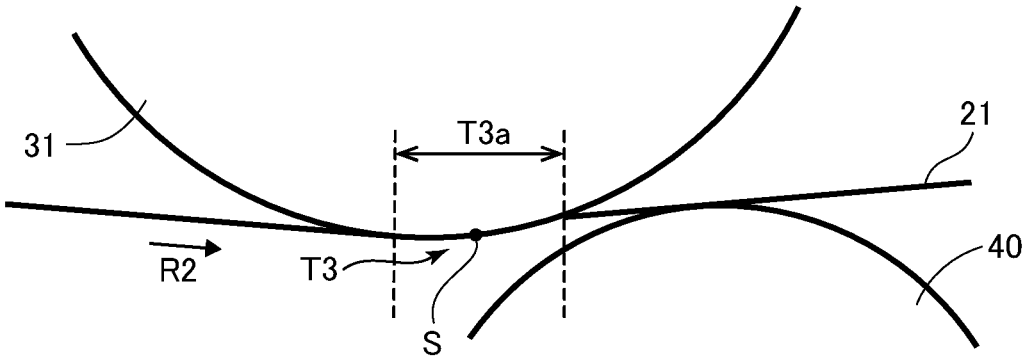
FIG. 13B is a magnified diagram illustrating a nip portion in the belt cleaning apparatus of another embodiment.

Meanwhile, the first to fifth embodiments described above have been explained on the premise that a physical nip T3*b* is formed; however, the present invention is not limited to this. For example, the opposed roller 40 may be offset on a further downstream side so as to form only a tension nip T3*a*, without forming a physical nip T3*b* between the cleaning roller 31 and the intermediate transfer belt 21. A belt cleaning apparatus in the case in which a physical nip T3*b* is not formed will be described using FIG. 13A and FIG. 13B. In FIG. 13A and FIG. 13B, the same reference symbols will be assigned to configurations similar to the second embodiment described above (see FIG. 7A and FIG. 7B), and further explanation and depiction will be omitted or simplified.

As shown in FIG. 13A, tangential line I' of the cleaning roller 31 at the central position S in the moving direction of the intermediate transfer belt 21 at the nip portion T3 will be considered. In the case of the present embodiment, as shown in FIG. 13B, since only a tension nip T3*a* is formed between the cleaning roller 31 and the intermediate transfer belt 21, the central position S in the moving direction is at the center of the tension nip T3*a* in relation to the moving direction of the intermediate transfer belt 21.

Here, when a roller that initially applies tension to the intermediate transfer belt 21 on the downstream side of the cleaning roller 31 in the moving direction of the intermediate transfer belt 21 is designated as a first roller, in the case of the present embodiment, the first roller corresponds to the opposed roller 40. The opposed roller 40 is disposed at a position at which the position that is in close contact with the intermediate transfer belt 21 does not overlap with the tension nip T3*a* in relation to the moving direction of the intermediate transfer belt 21 (see FIG. 13B). On the other hand, when a roller that initially applies tension to the intermediate transfer belt 21 on the upstream side of the cleaning roller 31 in the moving direction of the intermediate transfer belt 21 is designated as a second roller, in the case of the present embodiment, the second roller corresponds to the secondary transfer inner roller 25. The secondary transfer inner roller 25 is also disposed at a position at which the position that is in close contact with the intermediate transfer belt 21 does not overlap with the tension nip T3*a*. Then, at least one roller between the opposed roller 40 and the secondary transfer inner roller 25 may be installed on the same side as the cleaning roller 31 with respect to the above-described tangential line I'. In the present embodiment, the opposed roller 40 and the secondary transfer inner roller 25 are both installed on the same side as the cleaning roller 31 with respect to the tangential line I'.

Meanwhile, in the respective embodiments described above, an example in which the cleaning roller 31 and the driving roller 23 or the secondary transfer inner roller 25 are driven by separate driving sources (motors) is disclosed; however, the present invention is not limited to this. For example, the cleaning roller 31, driving roller 23, and secondary transfer inner roller 25 may be configured such that the respective rollers are rotary-driven by transferring a rotary drive force produced by a single driving source (motor) by a gear unit including a number of gears.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

The present image forming apparatus is suitable to be used particularly for cases where a liquid developer is used.

What is claimed is:

1. An image forming apparatus, comprising:

a belt member configured to rotate while carrying a liquid developer comprising a toner and a carrier liquid, the belt member being nipped respectively at a first transfer position for transferring a toner image onto the belt member and at a second transfer position for transferring the transferred toner image onto a recording material;

a cleaning roller disposed upstream of the first transfer position and downstream of the second transfer position with respect to a moving direction of the belt member, the cleaning roller being configured to contact with an outer peripheral surface of the belt member at a contact portion and clean the belt member, the cleaning roller being driven in the same direction as the moving direction of the belt member at the contact portion;

an opposed roller configured to oppose the cleaning roller, with the belt member being interposed therebetween;

a driving roller disposed upstream of the first transfer position and downstream of the contact portion with respect to the moving direction of the belt member, the driving roller contacting with an inner peripheral surface of the belt member and driving the belt member;

a first driving source configured to drive the cleaning roller; and a second driving source configured to drive the driving roller, wherein when a roller disposed downstream of the contact portion, upstream of the first transfer position and adjacent to the cleaning roller with respect to the moving direction of the belt member and configured to tension the belt member is designated as a first roller, and a roller disposed upstream of the contact portion, downstream of the first transfer position and adjacent to the cleaning roller with respect to the moving direction of the belt member and configured to tension the belt member is designated as a second roller, at least a part of the cleaning roller is provided on the same side as the opposed roller with respect to an external common tangent of the first roller and the second roller, and in a case in which a surface velocity when the driving roller is driven is designated as v1; a surface velocity when the cleaning roller is driven is designated as v2; a radius of the cleaning roller is designated as r; a radius of the opposed roller is designated as s; and a distance between the center of rotation of the cleaning roller and the center of rotation of the opposed roller is designated as x, the cleaning roller is rotated so as to satisfy a relationship: $v2/v1<r/(x-s)$.

2. The image forming apparatus according to claim 1, wherein the cleaning roller is rotated so as to satisfy a relationship: $r/(x-s)-0.1<v2/v1$.

3. The image forming apparatus according to claim 1, wherein the belt member comprises a base layer, and an elastic layer formed around the base layer and having higher elasticity than the base layer, and in a case in which a thickness of the base layer is designated as t1, and a thickness of the elastic layer is designated as t2, a relationship: $t1<t2$ is satisfied.

4. The image forming apparatus according to claim 1, wherein the contact portion comprises a first contact portion and a second contact portion, respectively, at different positions in the moving direction of the belt member, the cleaning roller is in contact with the opposed roller at the first contact portion, with the belt member being interposed therebetween, the cleaning roller is in contact with the belt member and the opposed roller is not in contact with the belt member at the second contact portion, and a central position with respect to the moving direction at the first contact portion is disposed on a downstream side of a central position with respect to the moving direction at the second contact portion.

5. The image forming apparatus according to claim 1, wherein when a mobility of a toner is designated as μ ($m^2/(V\times s)$); a strength of an electric field generated at the contact portion along with application of a voltage is designated as E (V/m); a surface velocity of the belt member is designated as P (m/s); and a liquid thickness of a liquid developer at the contact portion is designated as d (μm), and a moving direction length of the contact portion is designated as L (m), the following expression is satisfied:

$$(\mu\times E)\times(L/P)>d.$$

6. The image forming apparatus according to claim 1, wherein the driving roller is a rubber roller, and the cleaning roller is a metal roller.

7. The image forming apparatus according to claim 1, wherein the cleaning roller contacts with the belt member at a contact pressure of from 30 N to 300 N.

8. The image forming apparatus according to claim 1, wherein the cleaning roller has a diameter of 40 mm or less.

9. The image forming apparatus according to claim 1, wherein the belt member is wound around the cleaning roller at a winding angle of less than 45°.

10. The image forming apparatus according to claim 1, wherein the belt member has a thickness of 1 mm or less.

11. The image forming apparatus according to claim 1, wherein the first roller is the driving roller.

12. The image forming apparatus according to claim 1, wherein the first roller is the opposed roller.

* * * * *